US011852397B2

(12) United States Patent
Choi et al.

(10) Patent No.: US 11,852,397 B2
(45) Date of Patent: Dec. 26, 2023

(54) REFRIGERATOR WITH AUTOMATIC DOOR OPENING AND CONTROLLING METHOD THEREOF

(71) Applicant: Samsung Electronics Co., Ltd., Suwon-si (KR)

(72) Inventors: Hyeonghwan Choi, Suwon-si (KR); Yongkeun Jee, Suwon-si (KR); Jungwon Choi, Suwon-si (KR); Jonghun Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 239 days.

(21) Appl. No.: 17/231,463

(22) Filed: Apr. 15, 2021

(65) Prior Publication Data

US 2021/0396453 A1 Dec. 23, 2021

(30) Foreign Application Priority Data

Jun. 19, 2020 (KR) ..... 10-2020-0075010

(51) Int. Cl.

| | |
|---|---|
| ***F25D 23/02*** | (2006.01) |
| ***F25D 29/00*** | (2006.01) |
| ***G08B 21/18*** | (2006.01) |
| ***G08B 5/36*** | (2006.01) |

(52) U.S. Cl.

CPC ..... *F25D 23/028* (2013.01); *F25D 29/005* (2013.01); *G08B 5/36* (2013.01); *G08B 21/182* (2013.01)

(58) Field of Classification Search

CPC ..... F25D 2700/04; F25D 2700/06; F25D 2323/021; E05F 15/73; E05F 15/611

See application file for complete search history.

(56) References Cited

U.S. PATENT DOCUMENTS

| | | | |
|---|---|---|---|
| 7,411,195 | B2 | 8/2008 | Narasako et al. |
| 11,339,602 | B2 | 5/2022 | Lee et al. |

(Continued)

FOREIGN PATENT DOCUMENTS

| | | | |
|---|---|---|---|
| JP | 2000-057389 | A | 2/2000 |
| JP | 2015-161476 | A | 9/2015 |

(Continued)

OTHER PUBLICATIONS

International Search Report dated Aug. 19, 2021, issued in International Patent Application No. PCT/KR2021/005017.

*Primary Examiner* — Lionel Nouketcha

(74) *Attorney, Agent, or Firm* — Jefferson IP Law, LLP

(57) ABSTRACT

A refrigerator is provided. The refrigerator includes a main body including a first door and a second door, a door opening device configured to open the first door and the second door, a first proximity sensor disposed adjacent to the first door, a second proximity sensor disposed adjacent to the second door, and a processor, and the processor may control the first proximity sensor and the second proximity sensor to operate alternately, based on sensing data obtained by the first proximity sensor and the second proximity sensor, identify a door close to an external object that approaches within a threshold distance from the refrigerator, and control the door opening device to open the identified door among the first door and the second door.

20 Claims, 28 Drawing Sheets

(56) References Cited

U.S. PATENT DOCUMENTS

| | | | | |
|---|---|---|---|---|
| 2015/0335175 | A1* | 11/2015 | Choueifati | A47F 3/0408 62/89 |
| 2019/0086141 | A1* | 3/2019 | Kim | F25D 23/028 |
| 2019/0330909 | A1 | 10/2019 | Lee et al. | |
| 2022/0213730 | A1 | 7/2022 | Lee et al. | |

FOREIGN PATENT DOCUMENTS

| | | | |
|---|---|---|---|
| JP | 2016-114315 | A | 6/2016 |
| KR | 10-2008-0004822 | A | 1/2008 |
| KR | 10-2017-0054741 | A | 5/2017 |
| KR | 10-2017-0082009 | A | 7/2017 |
| KR | 10-2018-0049674 | A | 5/2018 |
| KR | 10-2018-0049703 | A | 5/2018 |
| KR | 10-2019-0084860 | A | 7/2019 |
| KR | 10-2020-0007590 | A | 1/2020 |
| KR | 10-2076190 | B1 | 2/2020 |
| WO | 2016/175562 | A1 | 11/2016 |

* cited by examiner

REFRIGERATOR WITH AUTOMATIC DOOR OPENING AND CONTROLLING METHOD THEREOF

CROSS-REFERENCE TO RELATED APPLICATION(S)

This application is based on and claims priority under 35 U.S.C. § 119(a) of a Korean patent application number 10-2020-0075010, filed on Jun. 19, 2020, in the Korean Intellectual Property Office, the disclosure of which is incorporated by reference herein in its entirety.

BACKGROUND

1. Field

The disclosure relates to a refrigerator and a control method thereof. More particularly, this disclosure relates to a refrigerator capable of identifying an external object and automatically opening a door and a control method thereof.

2. Description of Related Art

A refrigerator may determine whether a person is in the vicinity of the refrigerator through a sensor. If it is determined that a person is in the vicinity of the refrigerator, the refrigerator may perform a predetermined operation. The predetermined operation may refer to changing a display to a power on state or outputting a voice notification, or the like.

The refrigerator may perform an operation of automatically opening or closing the door of the refrigerator according to a predefined condition. However, there may be a problem in that an additional operation of a person may be required to automatically open or close the door, and an automatic opening operation or closing operation may not be performed through a complete non-contact command.

In identifying a person, when using at least one sensor, there is a problem in that accuracy may fall in identifying whether a person approaches.

Therefore, there may be a problem in that it is difficult to grasp a user's intention regarding which door is to be opened, among a plurality of doors.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a refrigerator controlling a plurality of proximity sensors to operate alternately to identify a door intended by a user, among a plurality of doors, and a control method thereof.

Additional aspects will be set forth in part in the description which follows and, in part, will be apparent from the description, or may be learned by practice of the presented embodiments.

In accordance with an aspect of the disclosure, a refrigerator is provided. The refrigerator includes a main body including a first door and a second door, a door opening device configured to open the first door and the second door, a first proximity sensor disposed adjacent to the first door, a second proximity sensor disposed adjacent to the second door, and a controller, and the controller may control the first proximity sensor and the second proximity sensor to operate alternately, based on sensing data (or detection data) obtained by the first proximity sensor and the second proximity sensor, identify a door close to an external object that approaches within a threshold distance from the refrigerator, and control the door opening device to open the identified door among the first door and the second door.

The main body may further include a third door disposed below the first door and a fourth door disposed below the second door, and the first proximity sensor may be disposed on the third door, and the second proximity sensor may be disposed on the fourth door.

The refrigerator may further include a first light emitter disposed on the first door and a second light emitter disposed on the second door, and the controller may identify information about an approach distance of the external object, and control at least one of the first light emitter or the second light emitter based on the identified information about an approach distance.

The controller may, based on the external object approaching within a first threshold distance, turn on at least one of the first light emitter or the second light emitter, and based on the external object approaching within a second threshold distance that is shorter than the first threshold distance, control a light emitter disposed on the identified door of the first light emitter or the second light emitter to flicker.

The controller may, based on identifying that the external object is positioned within the second threshold distance for a first threshold time, and then moves out of the second threshold distance, control the door opening device to open the identified door, and based on identifying the external object in excess of a second threshold time greater than the first threshold time within the second threshold distance, control the door opening device not to open the identified door.

The refrigerator may further include an outputter, and the controller may, based on the external object being identified in excess of the second threshold time within the second threshold distance, output guide information through the outputter.

The refrigerator may further include a third proximity sensor disposed on the third door and a fourth proximity sensor disposed on the fourth door, and the controller may control the third proximity sensor and the fourth proximity sensor to operate alternately.

The controller may, based on identifying that an external object exists in a predetermined area corresponding to the third proximity sensor while the first door is opened, control the door opening device to stop (or pause) opening of the first door, and based on identifying that an external object exists in a predetermined area corresponding to the first proximity sensor while the second door is opened, control the door opening device to stop opening of the second door.

The controller may turn off the second proximity sensor and the fourth proximity sensor while the first proximity sensor and the third proximity sensor are turned on, and turn on the second proximity sensor and the fourth proximity sensor while the first proximity sensor and the third proximity sensor are turned off.

The third proximity sensor may be disposed on a lower portion (or bottom portion) of the third door, the fourth proximity sensor may be disposed on a lower portion (or bottom portion) of the fourth door, and a sensing direction of the third proximity sensor may be different from a sensing direction of the fourth proximity sensor.

The refrigerator may further include a third proximity sensor and a fifth proximity sensor disposed on the third door, a fourth proximity sensor and a sixth proximity sensor disposed on the fourth door, and the controller may turn off the second proximity sensor, the fourth proximity sensor, and the sixth proximity sensor while the first proximity sensor, the third proximity sensor, and the fifth proximity sensor are turned on, turn on the second proximity sensor, the fourth proximity sensor, and the sixth proximity sensor while the first proximity sensor, the third proximity sensor, and the fifth proximity sensor are turned off, and sensing directions of at least two sensors among the third proximity sensor to the sixth proximity sensor may be different.

In accordance with another aspect of the disclosure, a control method of a refrigerator comprising a main body including a first door and a second door, a door opening device to open the first door and the second door, a first proximity sensor disposed adjacent to the first door, and a second proximity sensor disposed adjacent to the second door is provided. The control method includes controlling the first proximity sensor and the second proximity sensor to operate alternately, based on sensing data obtained by the first proximity sensor and the second proximity sensor, identifying a door close to an external object that approaches within a threshold distance from the refrigerator and controlling the door opening device to open the identified door among the first door and the second door.

The main body may further include a third door disposed below the first door and a fourth door disposed below the second door, and the first proximity sensor may be disposed on the third door, and the second proximity sensor may be disposed on the fourth door.

The refrigerator may further include a first light emitter disposed on the first door and a second light emitter disposed on the second door, and the method may further include identifying information about an approach distance of the external object and controlling at least one of the first light emitter or the second light emitter based on the identified information about an approach distance.

The controlling at least one of the first light emitter or the second light emitter may include, based on the external object approaching within a first threshold distance, turning on at least one of the first light emitter or the second light emitter, and based on the external object approaching within a second threshold distance that is shorter than the first threshold distance, controlling a light emitter disposed on the identified door of the first light emitter or the second light emitter to flicker.

The control method of the refrigerator may further include, based on identifying that the external object is positioned within the second threshold distance for a first threshold time, and then moves out of the second threshold distance, controlling the door opening device to open the identified door, and based on identifying the external object in excess of a second threshold time greater than the first threshold time within the second threshold distance, controlling the door opening device not to open the identified door.

The refrigerator may further include an outputter, and the method may further include, based on the external object being identified in excess of the second threshold time within the second threshold distance, outputting guide information through the outputter.

The refrigerator may further include a third proximity sensor disposed on the third door and a fourth proximity sensor disposed on the fourth door, and the method may further include controlling the third proximity sensor and the fourth proximity sensor to operate alternately.

The control method of the refrigerator may further include, based on identifying that an external object exists in a predetermined area corresponding to the third proximity sensor while the first door is opened, controlling the door opening device to stop opening of the first door, and based on identifying that an external object exists in a predetermined area corresponding to the fourth proximity sensor while the second door is opened, controlling the door opening device to stop opening of the second door.

The control method of the refrigerator may further include turning off the second proximity sensor and the fourth proximity sensor while the first proximity sensor and the third proximity sensor are turned on and turning on the second proximity sensor and the fourth proximity sensor while the first proximity sensor and the third proximity sensor are turned off.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
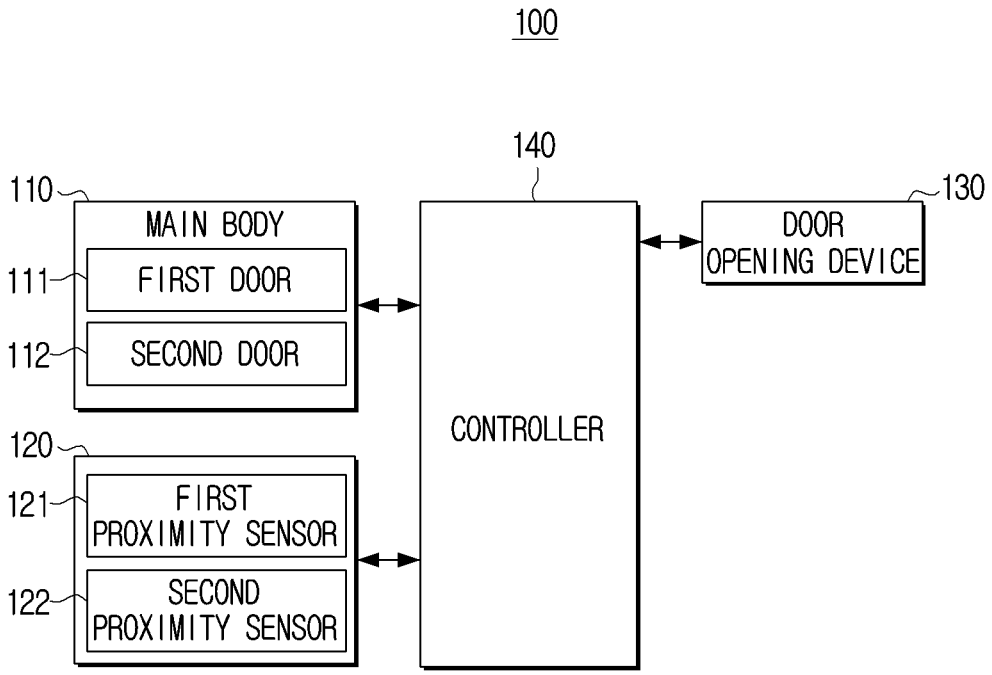
FIG. 1 is a block diagram of a refrigerator according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In this disclosure, the expressions "have," "may have," "include," or "may include" or the like represent presence of a corresponding feature (for example: components such as numbers, functions, operations, or parts) and does not exclude the presence of additional feature.

The expression "At least one of A or/and B" should be understood to represent "A" or "B" or any one of "A and B."

As used herein, the terms "first," "second," or the like may denote various components, regardless of order and/or importance, and may be used to distinguish one component from another, and does not limit the components.

In addition, the description in the disclosure that one element (e.g., a first element) is "(operatively or communicatively) coupled with/to" or "connected to" another element (e.g., a second element) should be interpreted to include both the case that the one element is directly coupled to the another element, and the case that the one element is coupled to the another element through another intervening element (e.g., a third element).

A singular expression includes a plural expression, unless otherwise specified. It is to be understood that the terms such as "comprise" or "consist of" are used herein to designate a presence of a characteristic, number, operation, element, component, or a combination thereof, and not to preclude a presence or a possibility of adding one or more of other characteristics, numbers, operations, elements, components or a combination thereof.

The term such as "module," "unit," "part," and so on may be used to refer to an element that performs at least one function or operation, and such element may be implemented as hardware or software, or a combination of hardware and software. Further, except for when each of a plurality of "modules," "units," "parts," and the like needs to be realized in an individual hardware, the components may be integrated in at least one module or chip and be realized in at least one processor (not shown).

In this disclosure, a term user may refer to a person using an electronic apparatus or an apparatus (for example: artificial intelligence (AI) electronic apparatus) that uses an electronic apparatus.

Hereinafter, various example embodiments of the disclosure will be described in greater detail with reference to the accompanying drawings.

FIG. 1 is a block diagram of a refrigerator according to an embodiment of the disclosure.

Referring to FIG. 1, a refrigerator 100 may include a main body 110, a proximity sensor 120, a door opening device 130, and a controller 140.

The refrigerator 100 may be a device to cool a cooled body by cooled air generated by passing through a compressor, a condenser, an expansion device, and an evaporator according to a cooling cycle for storage through refrigeration or freezing.

The main body 110 may include a first door 111 and a second door 112.

The proximity sensor 120 is a sensor for detecting an object even without contact and may be used to detect presence of an object in the vicinity of the refrigerator 100. One or a plurality of proximity sensors 120 may be disposed on a front surface of at least one of the plurality of doors. The proximity sensor 120 may be implemented as, for example, an optical proximity sensor, a capacitive proximity sensor, an inductive proximity sensor, or the like. The proximity sensor 120 may be an infrared (IR) proximity sensor 120. The refrigerator 100 may detect the approach of an external object through a front camera or a microphone as well as the proximity sensor 120.

The proximity sensor 120 may include a first proximity sensor 121 and a second proximity sensor 122.

The door opening device 130 may be a module for automatically opening a plurality of doors attached to the main body of the refrigerator 100. The door opening device 130 may be included in a door opening/closing module, and the door opening/closing module may include the door opening device 130 and a door closing device (not shown). The door opening/closing module may automatically close the at least one door using the door opening device 130 or automatically close the at least one door using a door closing device (not shown).

The controller 140 may perform overall control operations of the refrigerator 100. The controller 140 may function to control overall operations of the refrigerator 100.

The controller 140 may be implemented with at least one of a digital signal processor (DSP), a microprocessor, and a time controller (TCON), but is not limited thereto. The controller 140 may include at least one of a central processing unit (CPU), a micro controller unit (MCU), a micro processing unit, a controller, an application processor (AP), a graphics-processing unit (GPU), a communication processor (CP), and an advanced reduced instruction set computing (RISC) machine (ARM) processor or may be defined as a corresponding term. The controller 140 may be implemented in a system on chip (SoC) type or a large scale integration (LSI) type in which a processing algorithm is built therein or in a field programmable gate array (FPGA) type. The controller 140 may perform various functions by executing computer executable instructions stored in the memory.

The refrigerator 100 according to the embodiment may include the main body 110 including the first door 111 and the second door 112, the door opening device 130 for opening the first door 111 and the second door 112, a first proximity sensor 121 disposed adjacent to the first door 111, a second proximity sensor 122 disposed adjacent to the second door 112, and the controller 140.

The controller 140 may control the first proximity sensor 121 and the second proximity sensor 122 to operate alternately, identify a door close to an external object approaching within a threshold distance from the refrigerator 100 based on the sensing data (or detection data) obtained by the first proximity sensor 121 and the second proximity sensor 122, and control the door opening device 130 to open the identified door of the first door 111 and the second door 112.

Alternately controlling may refer that the first proximity sensor 121 and the second proximity sensor 122 are not operated simultaneously, but when the first proximity sensor 121 operates, the second proximity sensor 122 is not operated, and when the first proximity sensor 121 does not operate, the second proximity sensor 122 operates. A detailed description of the alternate control will be described later with reference to FIGS. 7, 12, and 17.

The controller 140 may obtain sensing data from the first proximity sensor 121 and the second proximity sensor 122, as the first proximity sensor 121 and the second proximity sensor 122 operate according to a predetermined period. The controller 140 may identify whether an external object exists in a sensing direction of the first proximity sensor 121 or a sensing direction of the second proximity sensor 122 based on the obtained sensing data, and may identify whether an external object is at a certain distance when the external object is identified.

The controller 140 may compare the sensing data obtained by the first proximity sensor 121 with the sensing data obtained by the second proximity sensor 122. Since the first proximity sensor 121 and the second proximity sensor 122 are alternately operated, the first proximity sensor 121 and the second proximity sensor 122 may not identify the access of the external object simultaneously. However, when the period of the alternate operation is narrowed with a short time, the external object may be sensed by the first proximity sensor 121 and the second proximity sensor 122. Here, the controller 140 may identify to which sensor between the first proximity sensor 121 or the second proximity sensor 122, the external object is closer. If it is identified that the external object is close to the first proximity sensor 121, the controller 140 may identify that the external object approaches the first door 111. If it is identified that the external object is close to the second proximity sensor 122, the controller 140 may identify that the external object approaches the second door 112.

The controller 140 may control the door opening device 130 to open at least one of the identified first door 111 or the second door 112 based on a predetermined event. Here, a detailed description of the predetermined event will be described later with reference to FIGS. 19 to 26.

According to an embodiment, based on identifying by the controller 140 that the external object is within a threshold distance from the first proximity sensor 121 and the second proximity sensor 122, the door opening device 130 may be controlled to open both the first door 111 and the second door 112.

The main body 110 may further include a third door 113 disposed below the first door 111 and a fourth door 114 disposed under the second door 112, and the first proximity sensor 121 may be disposed on the third door 113, and the second proximity sensor 122 may be disposed in a space of the fourth door 114.

The second door 112 may be disposed adjacent to the first door 111 in a horizontal direction, the third door 113 may be disposed adjacent to the first door 111 in a vertical direction, and the fourth door 114 may be disposed adjacent to the first door 111 in a vertical direction.

The first proximity sensor 121 may be disposed in an upper portion of the third door 113 and may be disposed adjacent to the first door 111. The second proximity sensor 122 may be disposed in an upper portion of the fourth door 114 and may be disposed adjacent to the second door 112.

According to an implementation, the first proximity sensor 121 and the second proximity sensor 122 may be disposed in a bezel area other than the door. The first proximity sensor 121 may be disposed in a space between the first door 111 and the third door 113 on the main body 110, and the second proximity sensor 122 may be disposed in a space between the second door 112 and the fourth door 114 on the main body 110.

A description regarding proximity sensors 121, 122 of respective (or each) doors 111, 112, 113, 114 will be given with reference to FIG. 5.

The refrigerator 100 may further include a first light emitter 151 disposed on the first door 111 and a second light emitter 152 disposed on the second door 112, and the controller 140 may identify approach distance information of the external object and control at least one light emitter of the first light emitter 151 or the second light emitter 152 based on the approach distance information of the identified external object.

The first light emitter 151 and the second light emitter 152 may be units including at least one light emitting element. Each of the light emitters 151 and 152 may emit light. The first light emitter 151 may be disposed on a lower portion of the first door 111, and the second light emitter 152 may be disposed on a lower portion of the second door 112.

The controller 140 may identify information on approach distance of the external object based on sensing data obtained from the first proximity sensor 121 and the second proximity sensor 122. If the approach distance information of the external object is within the first threshold distance, at least one light emitter of the first light emitter 151 or the second light emitter 152 may be controlled to operate in a first light emitting mode. If the approach distance information is within the second threshold distance, at least one of the first light emitter 151 or the second light emitter 152 may be controlled to operate in the second light emitting mode.

For example, a first threshold distance may be 60 cm and a second threshold distance may be 30 cm. If the approach distance information of the external object is 50 cm, the controller 140 may control at least one of the first light emitter 151 or the second light emitter 152 to operate in the first light emitting mode. If the approach distance information of the external object is 20 cm, the controller 140 may control at least one light emitter of the first light emitter 151 or the second light emitter 152 in the second light emitting mode.

According to an embodiment, when the approach distance information of the identified external object is within the first threshold distance, the controller 140 may control the first light emitter 151 and the second light emitter 152 to operate in the first light emitting mode. If the approach distance information of the external object is within the second threshold distance after the first light emitter 151 and the second light emitter 152 operate in the first light emitting mode, the controller 140 may identify a door close to an external object between the first door 111 or the second door 112 and may control only the light emitter attached to the identified door to operate in the second light emitting mode. That is, when the external object approaches within the first threshold distance, both the first light emitter 151 and the second light emitter 152 may operate in the first light emitting mode, and then when the external object approaches within the second threshold distance, only one light emitter more adjacent to the external object may operate in the second light emitting mode. According to an embodiment, if it is determined that the external object approaches within the second threshold distance and opens both the first door 111 and the second door 112, both the first light emitter 151 and the second light emitter 152 may be controlled to operate in the second light emitting mode.

According to another embodiment, when the approach distance information of the identified external object is within the first threshold distance, the controller 140 may control only the light emitter identified to be closer to the external object between the first light emitter 151 and the second light emitter 152 to operate in the first light emitting mode. The controller 140 may obtain sensing data with only a proximity sensor disposed adjacent to the door including the identified light emitter after the identified light emitter operates in the first light emitting mode. The controller 140 may obtain the approach distance information of the external object by the obtained sensing data. If the approach distance information of the external object is within the second threshold distance, the controller 140 may control the identified light emitter to operate in the second light emitting mode. When the external object approaches within the first threshold distance, only the light emitter closer to the external object between the first light emitter 151 and the second light emitter 152 may operate in the first light emitting mode, and the proximity sensor adjacent to the light emitter operating in the first light emitting mode may be identified. The controller 140 may obtain sensing data only through the proximity sensor, and control the light emitter operating in the first light emitting mode to operate in the second light emitting mode when the approach distance information is within the second threshold distance.

When the external object approaches within the first threshold distance, the controller 140 may turn on at least one of the first light emitter 151 or the second light emitter 152 and when the external object approaches within a second threshold distance shorter than the first threshold distance, the controller 140 may control a light emitter disposed on the identified door of the first light emitter 151 or the second light emitter 152 to flicker.

According to an embodiment, the first light emitting mode may refer to a mode in which the light emitting element emits light with a predetermined illuminance, and the second light emitting mode may refer to a mode in which the light emitting element emits light in a flickering manner.

According to another embodiment, the first light emitting mode may be a mode for emitting light of a first color, and the second mode may be a mode for emitting light of a second color different from the first color.

According to another embodiment, the first light emitting mode and the second light emitting mode may be a mode of which least one of a light emitting time, a light emitting frequency, and a light emitting wavelength is different.

The controller 140 may control the door opening device 130 to open the identified door if the external object is identified as being located within the second threshold distance for the first threshold time and then moving out of the second threshold distance, and the controller 140 may control the door opening device 130 so as not to open the identified door if the external object is identified in excess of a second threshold time greater than the first threshold time within the second threshold distance.

The criterion for calculating the first threshold time and the second threshold time may be the time when the external object is initially sensed within the second threshold distance. For example, if the first external object approaches within 30 cm from the refrigerator 100, the controller 140 may identify whether the external object is within 30 cm from the refrigerator 100 at a first threshold time or a second threshold time.

The controller 140 may control the door opening device 130 to automatically open the door based on a predetermined event. The predetermined event may refer to an event in which an external object is identified within a first threshold distance and then an external object is identified within a second threshold distance, and then an external object is not detected within a second threshold distance thereafter. The detailed description related thereto will be described later with reference to FIGS. 19 to 23.

The refrigerator 100 may further include an outputter, and the controller 140, based on identifying the external object in excess of a second threshold time within the second threshold distance, may output guide information through the outputter.

The outputter may include at least one of a display 172 or a speaker 173. Here, if the external object is identified in excess of the second threshold time within the second threshold distance, the controller 140 may output guide information for transferring the content that a user should keep a distance from the door through the outputter. For example, the controller 140 may display image information indicating that the door may be automatically opened only when the user keeps a distance from the door through the display 172. The controller 140 may output, through the speaker 173, audio information indicating that the door may be automatically opened only when the user keeps a distance from the door.

The refrigerator 100 may further include a third proximity sensor 123 disposed on the third door 113 and a fourth proximity sensor 124 disposed on the fourth door 114, and the controller 140 may control the third proximity sensor 123 and the fourth proximity sensor 124 to operate alternately.

A specific description will be given with reference to FIGS. 8 to 12.

The controller 140, if it is identified that the external object exists in a predetermined area corresponding to the third proximity sensor 123 while the first door 111 is opened, may control the door opening device 130 to stop the opening of the first door 111, if it is identified that an external object exists in a predetermined area corresponding to the fourth proximity sensor 124 while the second door 112 is opened, the controller 140 may control the door opening device 130 to stop opening of the second door 112.

It is described that while the first door 111 is opened, but the controller 140 may control the door opening device 130 to stop opening of the door, even if the first door 111 is ready to be opened, not actually opened.

The controller 140 may turn off the second proximity sensor 122 and the fourth proximity sensor 124 while turning on the first proximity sensor 121 and the third proximity sensor 123, and turn off the second proximity sensor 122 and the fourth proximity sensor 124 while turning off the first proximity sensor 121 and the third proximity sensor 123.

The controller 140 may alternately control the first proximity sensor 121 to the fourth proximity sensor 124, and a detailed description will be given with reference to FIG. 12.

The third proximity sensor 123 may be disposed on the lower portion of the third door 113, the fourth proximity sensor 124 may be disposed on the lower portion of the fourth door 114, and the sensing direction of the third proximity sensor 123 and the sensing direction of the fourth proximity sensor 124 may be different.

The arrangement of the third proximity sensor 123 and the fourth proximity sensor 124 will be described later with reference to FIG. 8. The reason why the sensing directions of the third proximity sensor 123 and the fourth proximity sensor 124 are different may be due to the difference between the position of the light receiver and the light emitter. Since the light receiver of the proximity sensor is always biased in a predetermined direction, the external object sensing region of the refrigerator 100 may be biased in a predetermined direction if the sensing directions of the third proximity sensor 123 and the fourth proximity sensor 124 are the same. Accordingly, to overcome the above problem, the third proximity sensor 123 and the fourth proximity sensor 124 may be disposed such that the sensing directions of the third proximity sensor 123 and the fourth proximity sensor 124 are different. The detailed description related thereto will be described later with reference to FIG. 27.

The refrigerator 100 may further include the third proximity sensor 123 and the fifth proximity sensor 125 disposed on the third door 113, and the fourth proximity sensor 124 and the sixth proximity sensor 126 disposed on the fourth door 114, and the controller 140 may, while the first proximity sensor 121, the third proximity sensor 123, and the fifth proximity sensor 125 are turned on, turn off the second proximity sensor 122, the fourth proximity sensor 124, and the sixth proximity sensor 126, and while the first proximity sensor 121, the third proximity sensor 123, and the fifth proximity sensor 125 are opened, turn on the second proximity sensor 122, the fourth proximity sensor 124, and the sixth proximity sensor 126, and sensing directions of at least two sensors, among the third proximity sensor 123 to the sixth proximity sensor 126, may be different.

The third proximity sensor 123 and the fifth proximity sensor 125 may be disposed to be adjacent to the third door 113, and the fourth proximity sensor 124 and the sixth proximity sensor 126 may be disposed adjacent to the fourth door 114.

A detail will be described with reference to FIGS. 13 to 17.

According to an embodiment, the refrigerator 100 may identify which door of the plurality of doors is to be automatically opened. Here, the plurality of proximity sensors may be used, and the plurality of proximity sensors may be alternately controlled to prevent interference among the plurality of proximity sensors. If interference does not occur among the plurality of proximity sensors, the accuracy of identifying the door corresponding to the user's intention may be improved.

The refrigerator 100 according to another embodiment may control the light emitter so that the light emitting mode is different according to the sensing distance of the external object. This may improve the convenience of the user in that it is possible to intuitively guide the automatic opening operation for the user.

Figure 2:
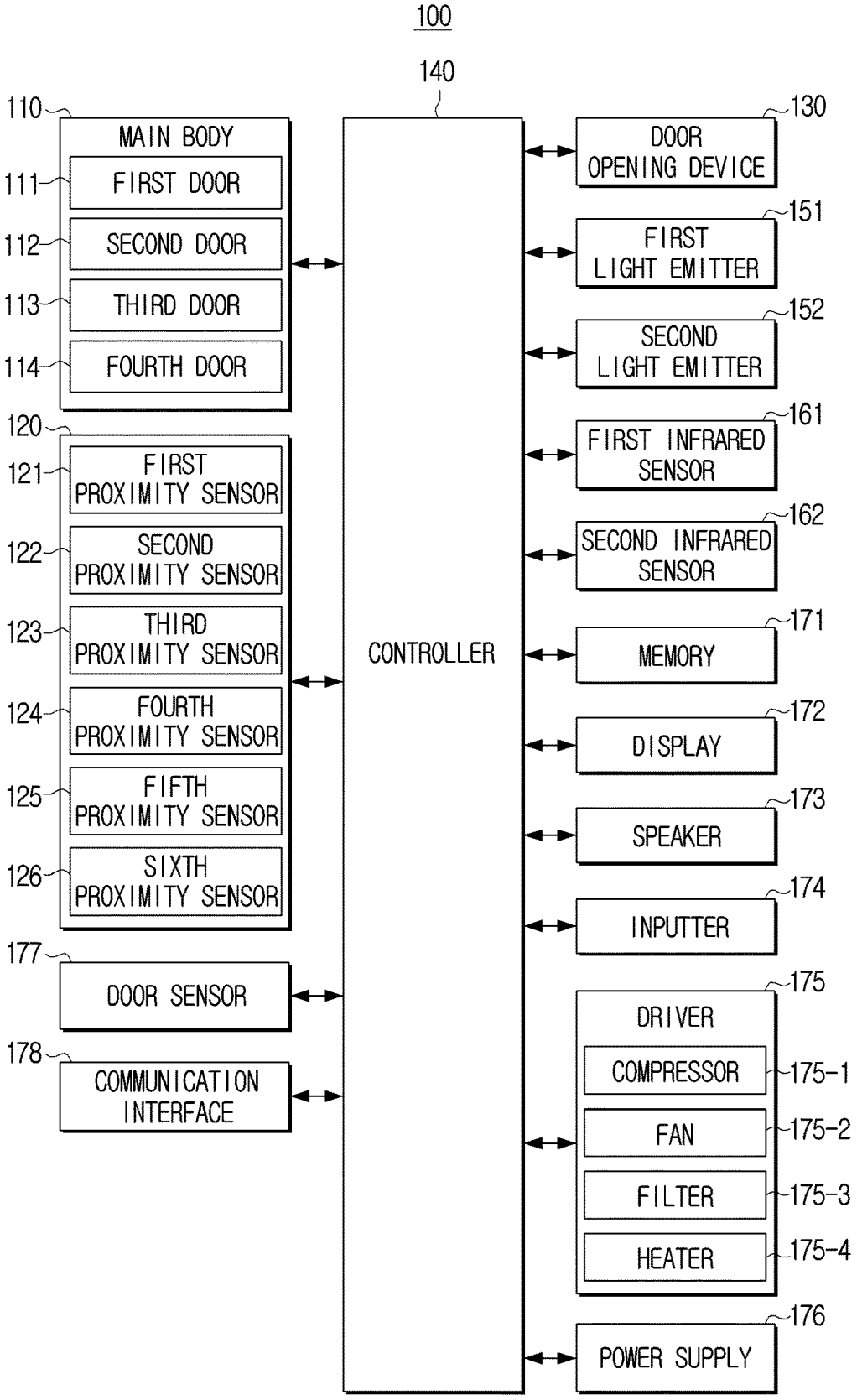
FIG. 2 is a detailed block diagram of a refrigerator according to FIG. 1 according to an embodiment of the disclosure.

FIG. 2 is a detailed block diagram of a refrigerator according to FIG. 1 according to an embodiment of the disclosure.

Referring to FIG. 2, the refrigerator 100 may include the main body 110, the proximity sensor 120, the door opening device 130, the controller 140, the first light emitter 151, the second light emitter 152, a first infrared sensor 161, a second infrared sensor 162, a memory 171, a display 172, a speaker 173, an inputter 174, a driver 175, a power supply 176, a door sensor 177, a communication interface 178, and a memory 179.

The description of the same operations as described above among the operations of the first door 111, the second door 112, the first proximity sensor 121, the second proximity sensor 122, the door opening device 130, and the controller 140 will be omitted.

The main body 110 may include a first door 111, a second door 112, a third door 113, and a fourth door 114.

The proximity sensor 120 may include a first proximity sensor 121, a second proximity sensor 122, a third proximity sensor 123, a fourth proximity sensor 124, a fifth proximity sensor 125, and a sixth proximity sensor 126.

The first light emitter 151 and the second light emitter 152 may include a plurality of light emitting elements and may emit light.

The first infrared sensor 161 and the second infrared sensor 162 may refer to a sensor for outputting infrared rays, receiving infrared rays reflected by an object, and detecting a position of the object.

The memory 171 may be implemented as an internal memory such as a read-only memory (ROM), such as electrically erasable programmable read-only memory (EEPROM), and a random-access memory (RAM) or a memory separate from the controller 140. In this case, the memory 171 may be implemented as at least one of a memory embedded within the refrigerator 100 or a memory detachable from the refrigerator 100 according to the usage of data storage. For example, the data for driving the refrigerator 100 may be stored in the memory embedded within the refrigerator 100, and the data for upscaling of the refrigerator 100 may be stored in the memory detachable from the refrigerator 100.

The display 172 may be implemented as a display of various types such as a liquid crystal display (LCD), organic light emitting diodes (OLED) display, plasma display panel (PDP), or the like. In the display 172, a backlight unit, a driving circuit which may be implemented as an a-si thin-film-transistor (TFT), low temperature poly silicon (LTPS) TFT, organic TFT (OTFT), or the like, may be included as well. In the meantime, the display 172 may be implemented as a touch screen coupled with a touch sensor, a flexible display, a third-dimensional (3D) display, or the like.

The speaker 173 may be configured to output various alarm sounds or voice messages as well as various audio data for which various processing operations are performed by an input/output interface.

The inputter 174 may receive various user inputs and deliver the user inputs to the controller 140. The inputter 174 may include a touch sensor, a (digital) pen sensor, a pressure sensor, a key, or the like. The touch sensor may use, for example, at least one of electrostatic, resistive, infrared, or ultrasonic methods. A (digital) pen sensor may, for example, be part of a touch panel or include a separate recognition sheet. The key may include, for example, a physical button, an optical key, or a keypad.

The driver 175 may further include a compressor 175-1 operating according to the control of the controller 140, the fan 175-2, the filter 175-3, or the heater 175-4. The driver 175 may further include lighting (not shown) or deodorizer (not shown).

The compressor 175-1 may compress the refrigerant, which is operating fluid of the refrigeration cycle, by the control of the controller 140. The freezing cycle may include a condenser (not shown) for converting the gaseous refrigerant compressed by the compressor 175-1 into a liquid refrigerant, an expander (not shown) for decompressing the liquid refrigerant, and an evaporator (not shown) for vaporizing the decompressed liquid refrigerant. The controller 140 may control the temperature of the storage chamber through vaporization of the refrigerant in the liquid state. In addition, the refrigerator may control the temperature of the storage chamber through a Peltier element (not shown) using a Peltier effect, and a magnetic cooling device (not shown) using a magnetocaloric effect.

The fan 175-2 may circulate outside air by the control of the controller 140. The air which gets hot by the cooling cycle may be heat-exchanged through the outside air and may be cooled.

The filter 175-3 may sterilize (or remove) germs which may float in or attached to a storage room by the control of the controller 140. The filter 175-3 may include an ion sterilizing purifier.

The heater 175-4 may remove frost which may be generated by the control of the controller 140. The heater 175-4 may include a defrosting heater.

The power supply 176 may supply power to the components of the refrigerator by the control of the controller 140. The power supply 176 may supply power input from an external power source to each component of the refrigerator through a power cord (not shown) under the control of the controller 140.

The door sensor 177 may be a sensor capable of identifying the opening or closing of a door attached to (included in) the refrigerator 100. The door sensor 177 may generate information corresponding to the opening or closing of the door, and the door sensor 177 may transmit the generated sensing information to the controller 140. The door sensor 177 may detect whether the refrigerator door or the freezer door is opened or closed. The door sensor 177 may be implemented in a form that generates an event when a user opens a door and outputs data. The door sensor 177 may confirm contact of a physical configuration so as to identify whether the door is opened or closed.

The communication interface 178 is configured to communicate with various types of external devices according to various types of communication methods. The communication interface 178 may include a Wi-Fi module, a Bluetooth module, an infrared communication module, a wireless communication module, or the like. The Wi-Fi module and Bluetooth module may perform communication by Wi-Fi mode and Bluetooth mode, respectively. The wireless communication module may include at least one communication chip performing communication according to various communication standards such as Zigbee, 3rd generation (3G), 3rd generation partnership project (3GPP), long term evolution (LTE), LTE advanced (LTE-A), 4th generation (4G), 5th generation (5G), or the like, in addition to the communication modes described above.

Figure 3:
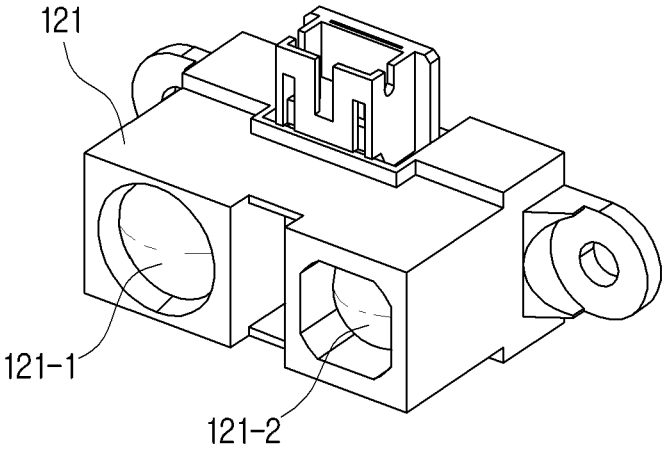
FIG. 3 is a perspective view of a proximity sensor according to an embodiment of the disclosure.

FIG. 3 is a perspective view of a proximity sensor according to an embodiment of the disclosure.

Referring to FIG. 3, the first proximity sensor 121 may include the light emitter 121-1 and the light receiver 121-2.

The first proximity sensor 121 may be a sensor for identifying an external object (object or person, etc.). According to an embodiment, the first proximity sensor 121 may output light having a predetermined wavelength through the light emitter 121-1 and receive light output through the light receiver 121-2. For example, the first proximity sensor 121 may be an infrared sensor.

According to another embodiment, the first proximity sensor 121 may identify an external object using an electromagnetic wave of a predefined wavelength or sound wave.

The content of the first proximity sensor 121 may be applied to the second proximity sensor 122 to the sixth proximity sensor 126 in the same manner.

Figure 4:
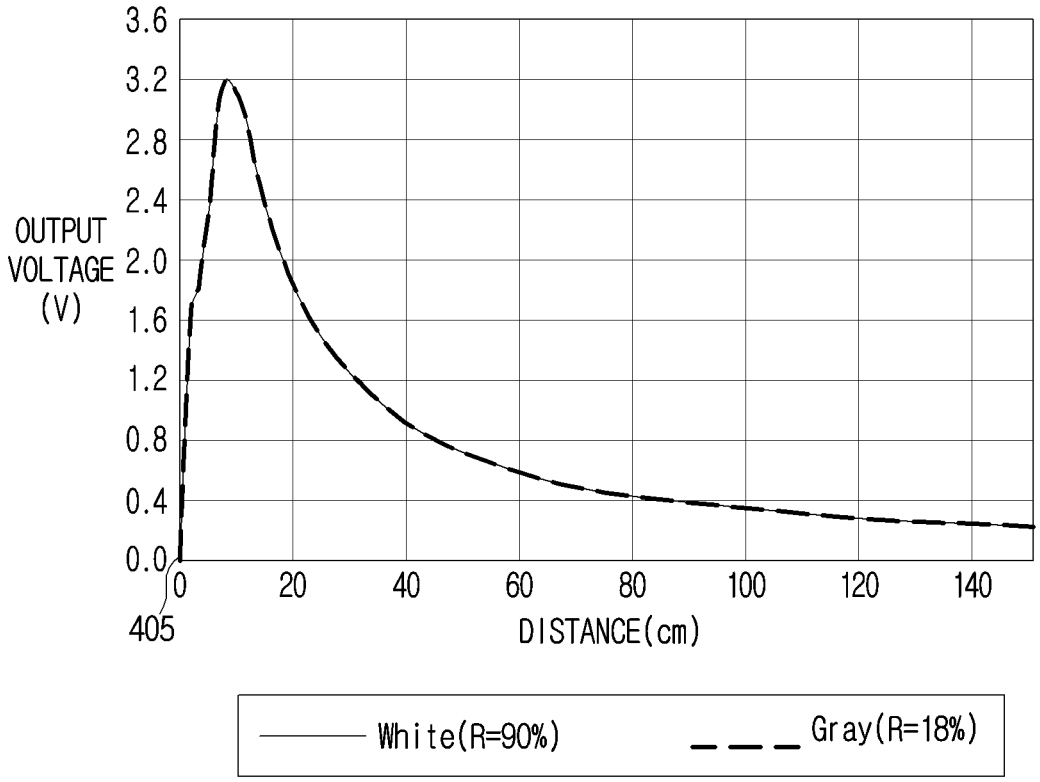
FIG. 4 is a diagram illustrating a feature graph of a proximity sensor according to an embodiment of the disclosure.

FIG. 4 is a diagram illustrating a feature graph of a proximity sensor according to an embodiment of the disclosure.

Referring to FIG. 4, the proximity sensors 121 to 126 may output a voltage differently according to a distance from an external object. Based on a graph 405, the proximity sensor may output the highest output voltage at a predefined distance (5 cm to 10 cm) and the output voltage of the proximity sensor may be lowered at a longer distance (a distance greater than 5 cm to 10 cm). The reflectivity may be different depending on the color of the external object. For example, a reflectivity of bright color (e.g., white) may be about 90%, and a reflectivity of dark color (e.g., gray) may be about 18%.

The output voltage of the proximity sensor may be lowered at a distance greater than the predefined distance, but the output voltage of the proximity sensor may rise within a distance shorter than a predefined distance. Therefore, the same distance where the output voltage of the proximity sensor is the same may occur. For example, the distance corresponding to the output voltage 2V of the proximity sensor may be about 4 cm and about 18 cm. Thus, at least two proximity sensors may be used to calculate the exact distance to the external object. For example, whether the external object is approaching may be detected using the first proximity sensor 121 and the second proximity sensor 122. The refrigerator 100 may detect whether an external object approaches based on sensing data obtained from at least two proximity sensors.

Figure 5:
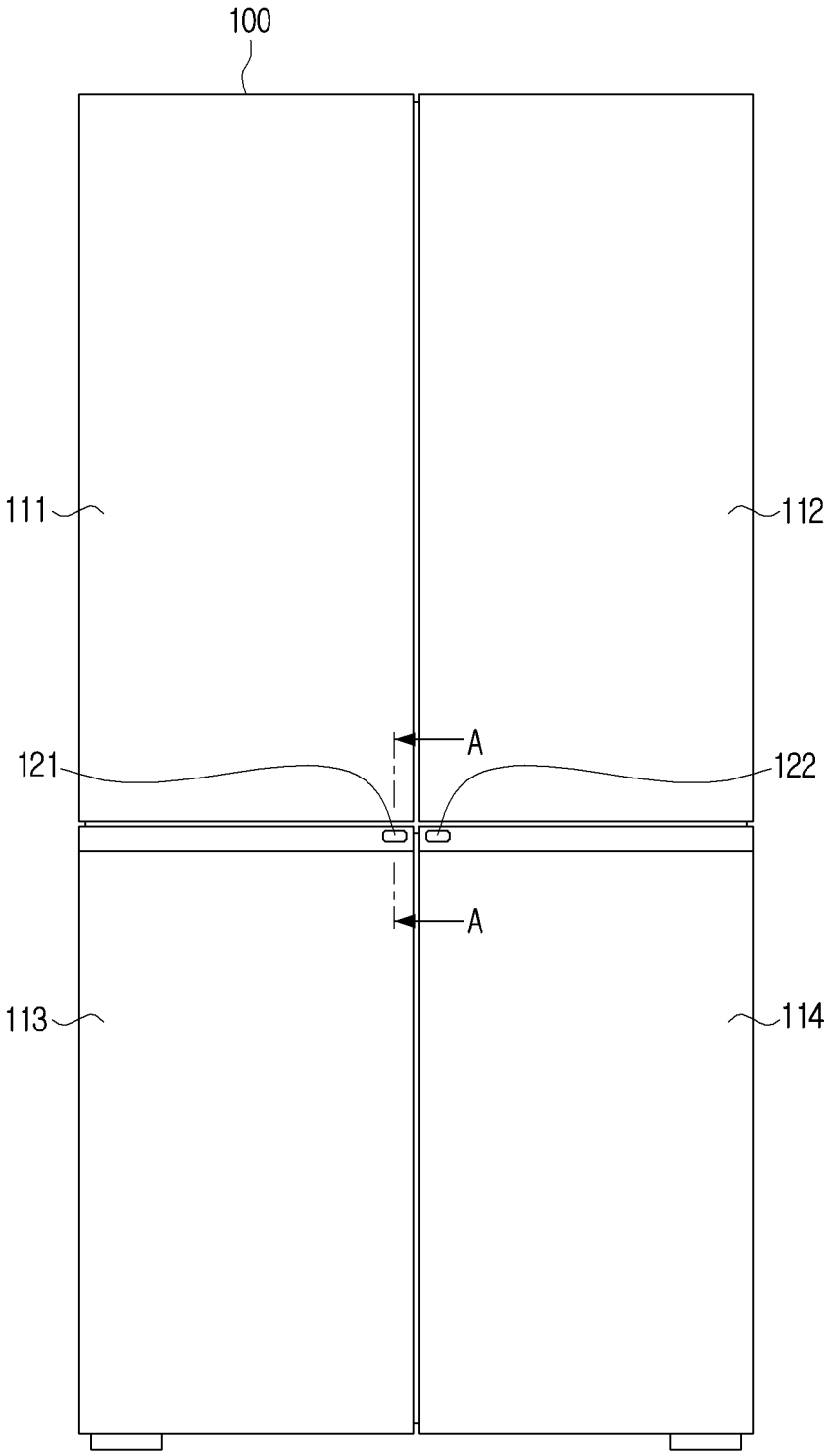
FIG. 5 is a front view of a refrigerator according to an embodiment of the disclosure.

FIG. 5 is a front view of a refrigerator according to an embodiment of the disclosure.

Referring to FIG. 5, the refrigerator 100 may include the first door 111, the second door 112, the third door 113, the fourth door 114, the first proximity sensor 121 and the second proximity sensor 122.

According to an embodiment, the first proximity sensor 121 and the second proximity sensor 122 may be disposed on the lower doors (i.e., the third door 113 and the fourth door 114, respectively). Specifically, the first proximity sensor 121 may be disposed on the third door 113, and the second proximity sensor 122 may be disposed on the fourth door 114.

According to another embodiment, the first proximity sensor 121 and the second proximity sensor 122 may be disposed on a central portion of the body of the refrigerator. The central portion of the refrigerator body may mean a central bezel that may distinguish between the first door 111 and the second door 112, the third door 113 and the fourth door 114.

The refrigerator 100 may obtain sensing data using the first proximity sensor 121 and the second proximity sensor 122 and may perform a door opening operation based on the obtained sensing data.

Figure 6:
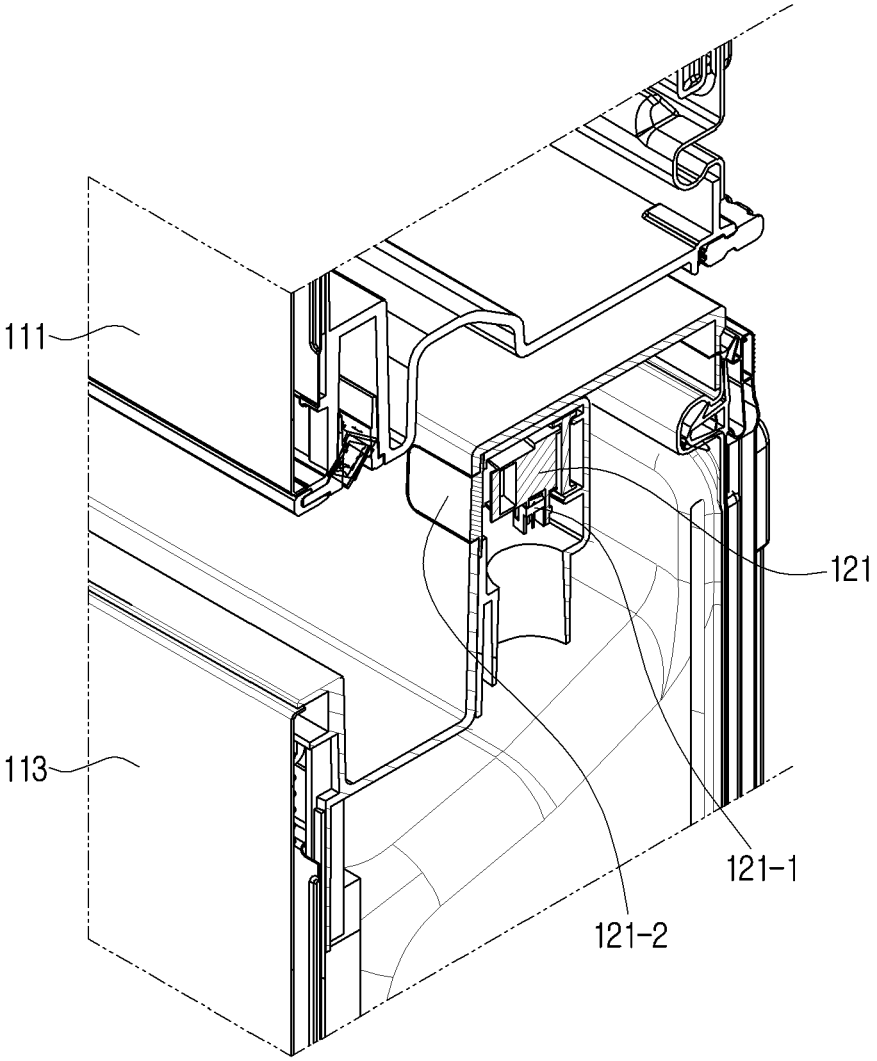
FIG. 6 is a perspective view in a direction of A-A of FIG. 5 according to an embodiment of the disclosure.

FIG. 6 is a perspective view in a direction of A-A of FIG. 5 according to an embodiment of the disclosure.

Referring to FIG. 6, the first proximity sensor 121 may be disposed on an upper end of the third door 113. The first proximity sensor 121 may be disposed on the right side of the third door 113. The first proximity sensor 121 may be disposed to be not in contact with the lower portion of the first door 111.

The second proximity sensor 122 may be disposed on the upper end of the fourth door 114. Specifically, the second proximity sensor 122 may be disposed on the left side of the upper end of the fourth door 114. The second proximity sensor 122 may be disposed to be not in contact with the lower portion of the second door 112.

Figure 7:
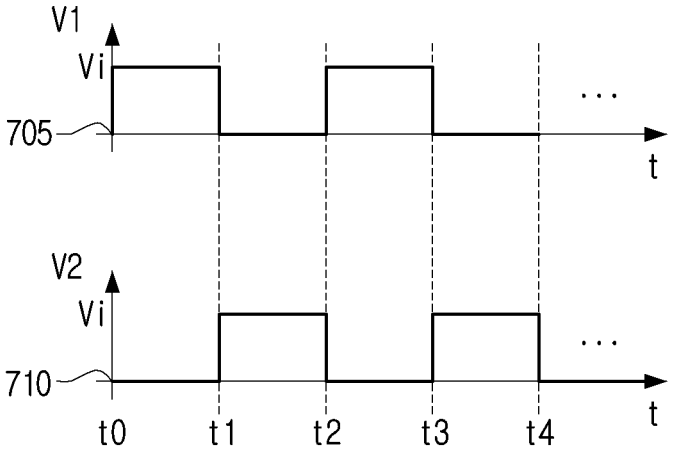
FIG. 7 is a diagram illustrating an alternate control operation of a refrigerator according to an embodiment of the disclosure.

FIG. 7 is a diagram illustrating an alternate control operation of a refrigerator according to an embodiment of the disclosure.

Referring to FIG. 7, graphs 705, 710 may refer to applicable voltage over time of the respective proximity sensors 121 and 122.

When the first proximity sensor 121 is turned on, the second proximity sensor 122 may be turned off. The state where the proximity sensor is turned off may mean that the voltage applied to the proximity sensor corresponds to the v1 value, and the state in which the proximity sensor is turned off may mean that the voltage applied to the proximity sensor corresponds to 0. The voltage v1 may refer to a voltage applied to the first proximity sensor 121, and v2 may refer to a voltage applied to the second proximity sensor 122.

The refrigerator 100 may control proximity sensors such that the second proximity sensor 122 is turned off when the first proximity sensor 121 is turned on from 0 to t1. The refrigerator 100 may control proximity sensors such that the second proximity sensor 122 is turned on when the first proximity sensor 121 is turned off from the point in time t1 to t2. The refrigerator 100 may control the proximity sensors such that the second proximity sensor 122 is turned off when the first proximity sensor 121 is turned on from the time t2 to the time t3. When the first proximity sensor 121 is turned off from t3 to t4, the refrigerator 100 may control the proximity sensors so that the second proximity sensor 122 is turned on.

Figure 8:
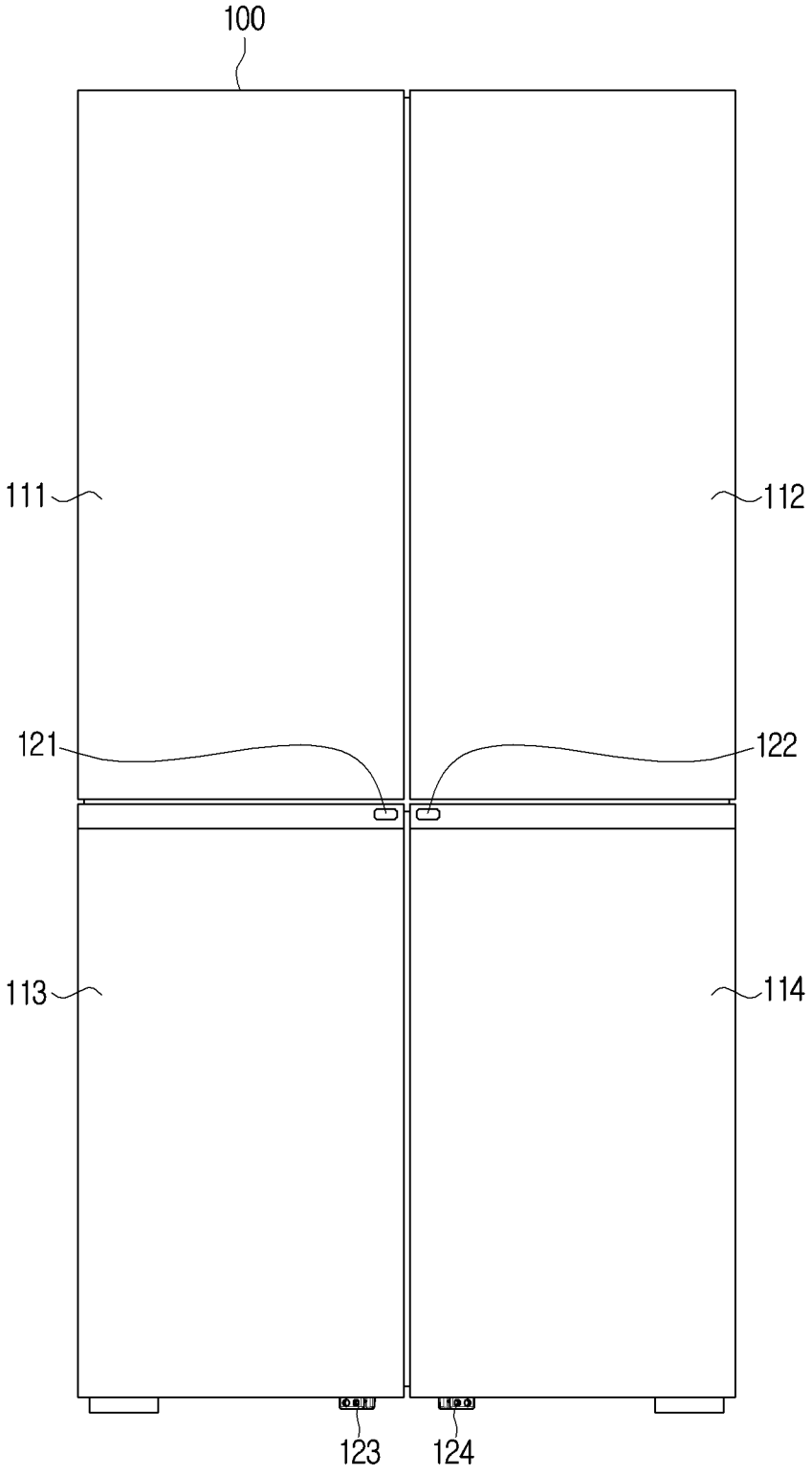
FIG. 8 is a front view illustrating a refrigerator according to an embodiment of the disclosure.

FIG. 8 is a front view illustrating a refrigerator according to an embodiment of the disclosure.

Referring to FIG. 8, the refrigerator 100 may include the first door 111, the second door 112, the third door 113, the fourth door 114, the first proximity sensor 121, the second proximity sensor 122, the third proximity sensor 123, and the fourth proximity sensor 124.

The first door 111, the second door 112, the third door 113, the fourth door 114, the first proximity sensor 121, and the second proximity sensor 122 have been described with reference to FIG. 5 and will not be further described to avoid redundancy.

According to an embodiment, the third proximity sensor 123 and the fourth proximity sensor 124 may be disposed on the lower portion of the refrigerator 100. Specifically, the third proximity sensor 123 and the fourth proximity sensor 124 may be disposed on the lower portion of the refrigerator to sense an external object located on the front surface of the refrigerator 100.

The third proximity sensor 123 and the fourth proximity sensor 124 may have different sensing directions facing the front surface of the refrigerator 100. Specifically, that the sensing direction is different may mean that the arrangement angle of the sensor is different based on a plane parallel to the lower portion of the door.

Figure 9:
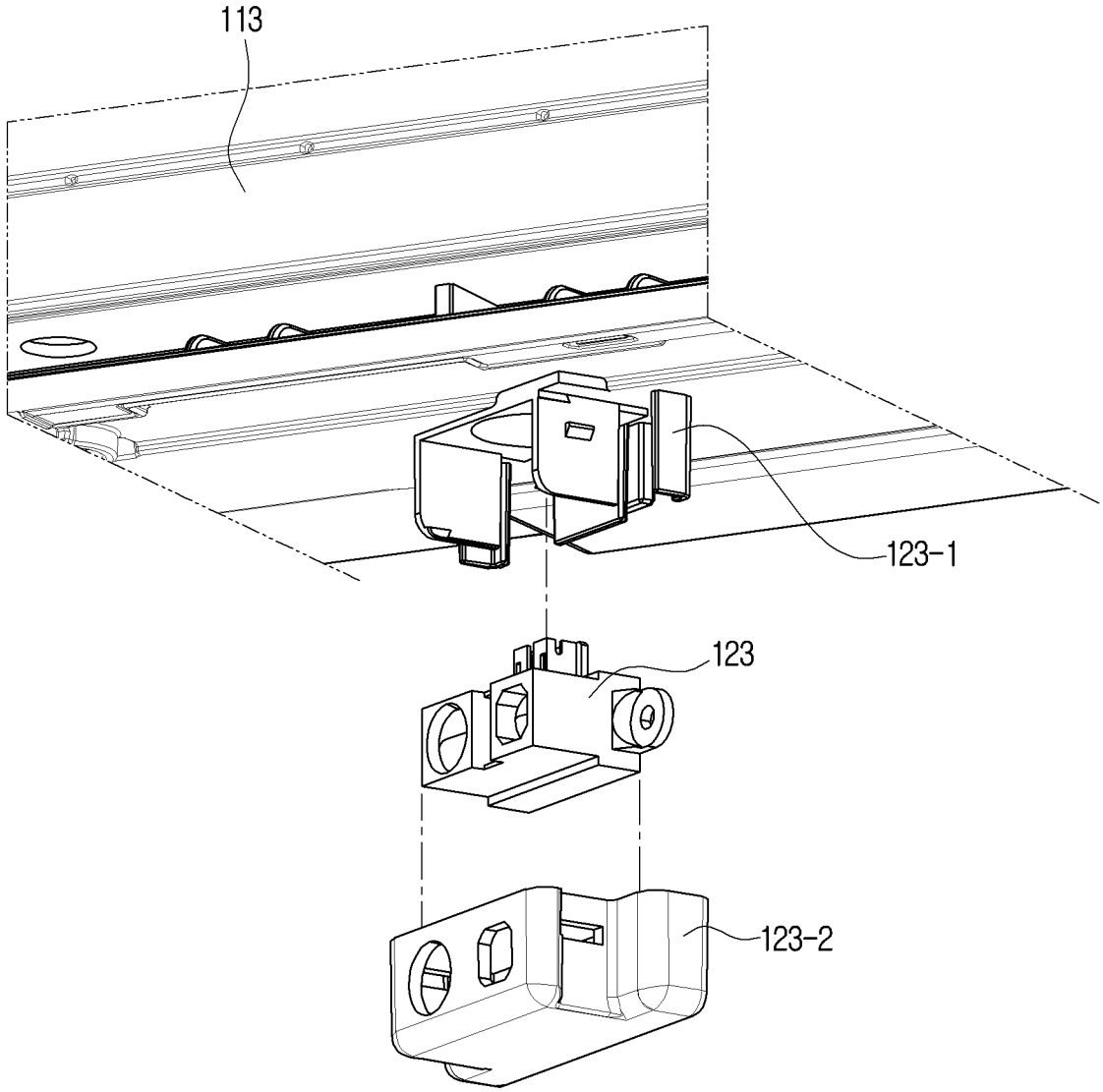
FIG. 9 is a perspective view of a third door according to an embodiment of the disclosure.

FIG. 9 is a perspective view of a third door according to an embodiment of the disclosure.

Referring to FIG. 9, the third proximity sensor 123 may be disposed on the lower portion of the third door 113, and the third proximity sensor 123 may be attached to the third proximity sensor 123 by a fixer 123-1 and a cover 123-2. Here, the fixer 123-1 may have a shape corresponding to the shape of the third proximity sensor 123 so as to be in contact with the lower portion of the third door 113 and that the third proximity sensor 123 may be attached. The cover 123-2 may have a shape corresponding to the fixer 123-1 and the third proximity sensor 123 to protect the third proximity sensor 123.

Figure 10:
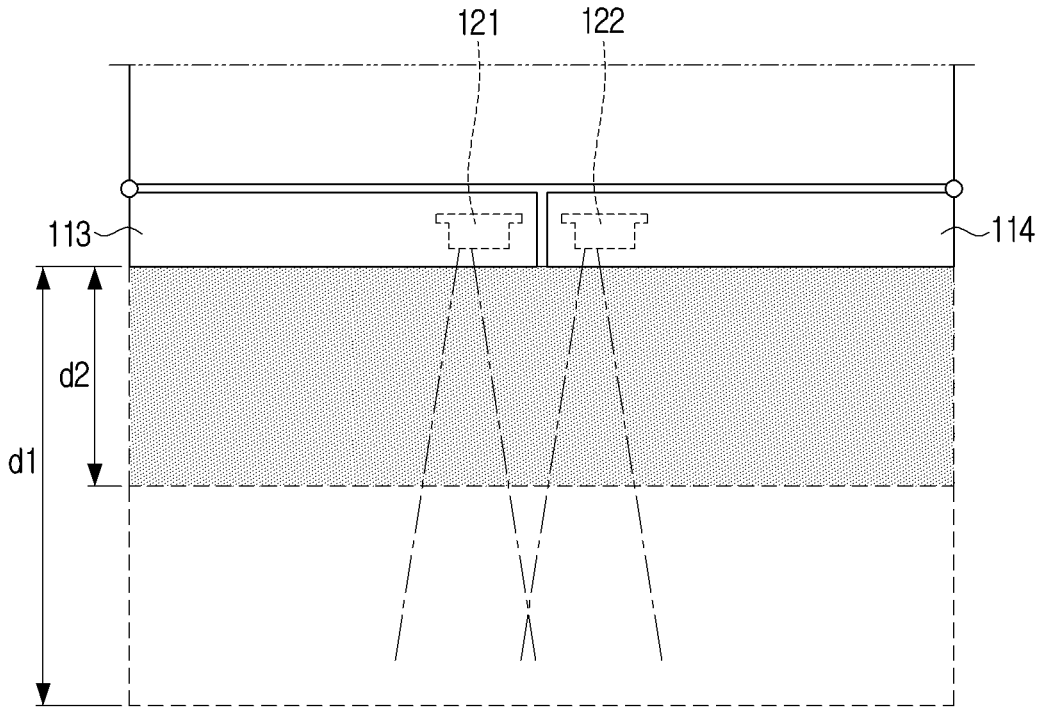
FIG. 10 is a plan view of a third door and a fourth door according to an embodiment of the disclosure.

FIG. 10 is a plan view of a third door and a fourth door according to an embodiment of the disclosure.

Referring to FIG. 10, the first proximity sensor 121 may be disposed on an upper portion of the third door 113, and the second proximity sensor 122 may be disposed on an upper portion of the fourth door 114. The first proximity sensor 121 and the second proximity sensor 122 may be disposed in the same sensing direction toward the front surface of the refrigerator 100.

When the first proximity sensor 121 and the second proximity sensor 122 are arranged in the same sensing direction, the sensing area of the first proximity sensor 121 and the sensing area of the second proximity sensor 122 may be partially overlapped. The sensing area may refer to a predetermined area in which the proximity sensor may sense an external object. The predetermined area may be divided into a plurality of areas (a dangerous area, a sensing area) according to a user setting.

Figure 11:
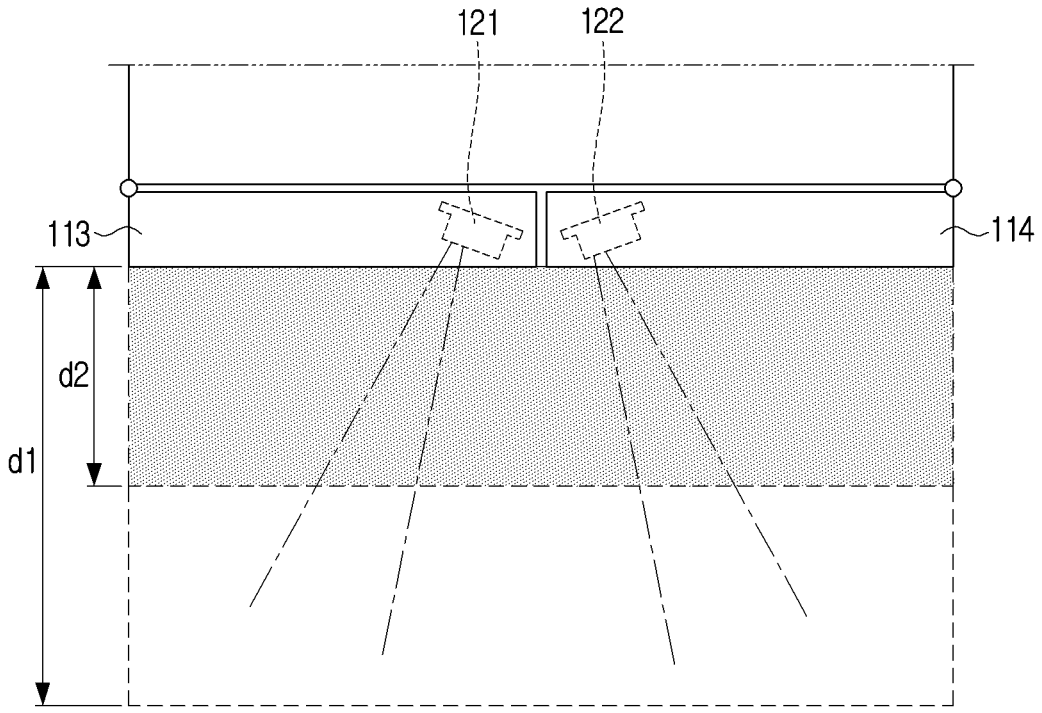
FIG. 11 is a plan view of a third door and a fourth door according to an embodiment of the disclosure.

FIG. 11 is a plan view of a third door and a fourth door according to an embodiment of the disclosure.

Referring to FIG. 11, the first proximity sensor 121 and the second proximity sensor 122 may be arranged to face the front surface and the sensing direction is shifted to the left or right with reference to the front surface. The first proximity sensor 121 may be rotated to the right side of the refrigerator 100 by a first threshold angle, and the second proximity sensor 122 may be rotated to the left toward the front surface of the refrigerator 100 by a second threshold angle. Here, the first threshold angle and the second threshold angle may be different.

Unlike the embodiment of FIG. 10, in which the first proximity sensor 121 and the second proximity sensor 122 are disposed without rotation toward the front surface, the first proximity sensor 121 and the second proximity sensor 122 of FIG. 11 may be arranged in a state where the sensing direction is moved to the left or right. Therefore, unlike the embodiment of FIG. 10, the sensing area of the first proximity sensor 121 and the sensing area of the second proximity sensor 122 may not overlap. The first proximity sensor 121 and the second proximity sensor 122 may be arranged so that the sensing area is not overlapped.

The rotation angle at which the first proximity sensor 121 and the second proximity sensor 122 are disposed may be smaller than the rotation angle of the third proximity sensor 123 to the sixth proximity sensor 126. The first proximity sensor 121 and the second proximity sensor 122 may detect a central region of the front surface of the refrigerator 100, and the third proximity sensor 123 to the sixth proximity sensor 126 may sense a left area or a right area of the front surface of the refrigerator 100.

Figure 12:
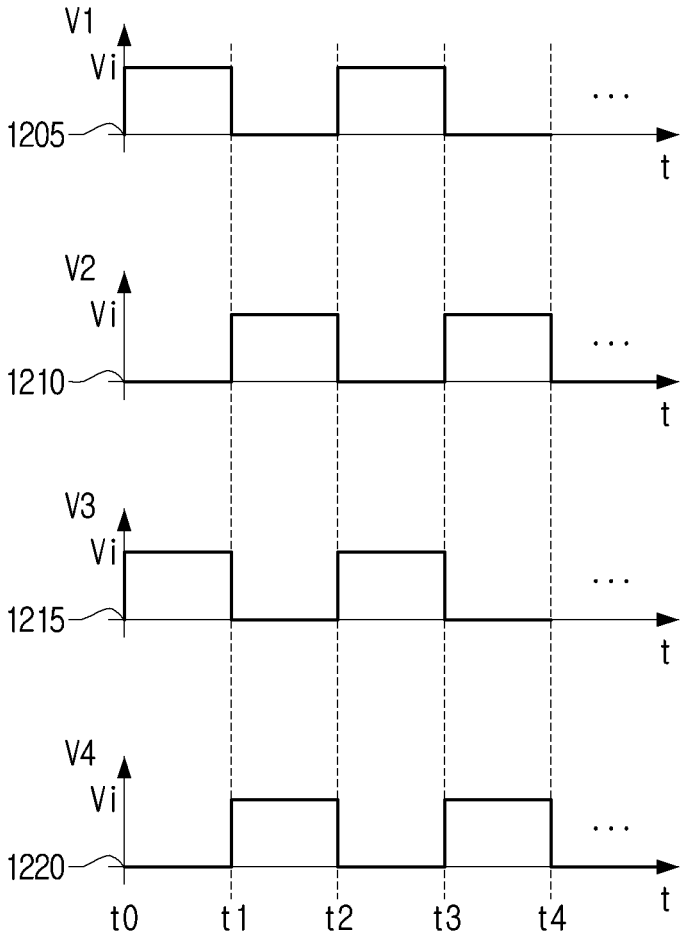
FIG. 12 is a diagram illustrating alternate control operation of a refrigerator according to an embodiment of the disclosure.

FIG. 12 is a diagram illustrating alternate control operation of a refrigerator according to an embodiment of the disclosure.

Referring to FIG. 12, graphs 1205, 1210, 1215, and 1220 may refer to the applied voltage over time of the respective proximity sensors 121, 122, 123, and 124.

Here, v3 may refer to the voltage applied to the third proximity sensor 123 and v4 may refer to the voltage applied to the fourth proximity sensor 124. The other description is the same as FIG. 7 and will not be further described to avoid redundancy.

When the first proximity sensor 121 and the third proximity sensor 123 are turned on from 0 to t1, the second proximity sensor 122 and the fourth proximity sensor 124 may control proximity sensors to be turned off. When the first proximity sensor 121 and the third proximity sensor 123 are turned off from t1 to t2, the refrigerator 100 may control proximity sensors such that the second proximity sensor 122 and the fourth proximity sensor 124 are turned on. If the first proximity sensor 121 and the third proximity sensor 123 are turned on from the t2 to t3, the second proximity sensor 122 and the fourth proximity sensor 124 may control the proximity sensors to be turned off. If the first proximity sensor 121 and the third proximity sensor 123 are turned off from t3 to t4, the refrigerator 100 may control proximity sensors such that the second proximity sensor 122 and the fourth proximity sensor 124 are turned on.

Figure 13:
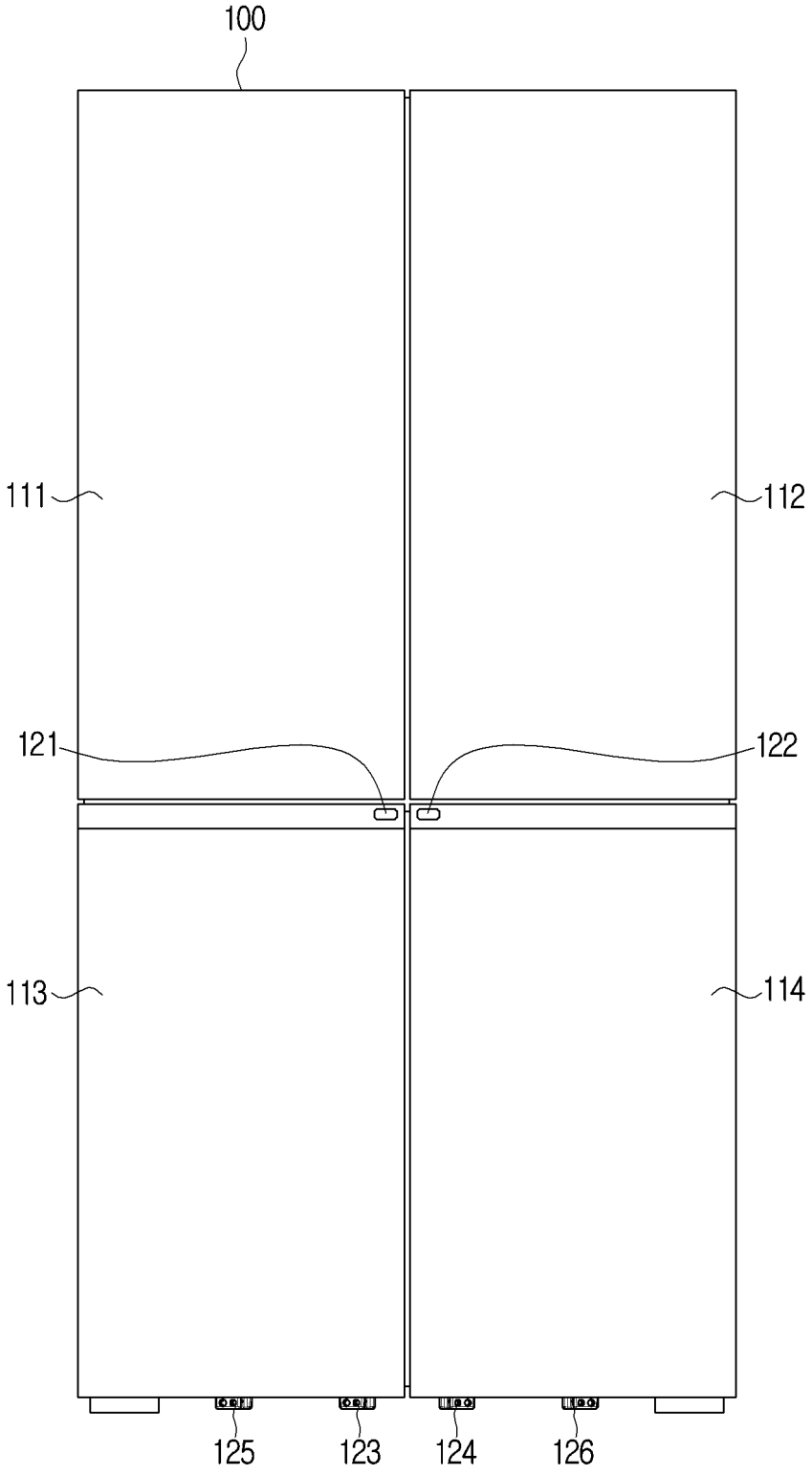
FIG. 13 is a front view of a refrigerator according to an embodiment of the disclosure.

FIG. 13 is a front view of a refrigerator according to an embodiment of the disclosure.

Referring to FIG. 13, the refrigerator 100 may include the first door 111, the second door 112, the third door 113, the fourth door 114, the first proximity sensor 121, the second proximity sensor 122, the third proximity sensor 123, the fourth proximity sensor 124, a fifth proximity sensor 125, and a sixth proximity sensor 126.

The third proximity sensor 123 and the fifth proximity sensor 125 may be disposed on the third door 113, and the fourth proximity sensor 124 and the sixth proximity sensor 126 may be disposed in the fourth door 114. The third proximity sensor 123 and the fifth proximity sensor 125 may be disposed on the lower portion of the third door 113, and the fourth proximity sensor 124 and the sixth proximity sensor 126 may be disposed on the lower portion of the fourth door 114.

The first proximity sensor 121 may be disposed on an upper portion of the third door 113, and the second proximity sensor 122 may be disposed on an upper portion of the fourth door 114.

Figure 14:
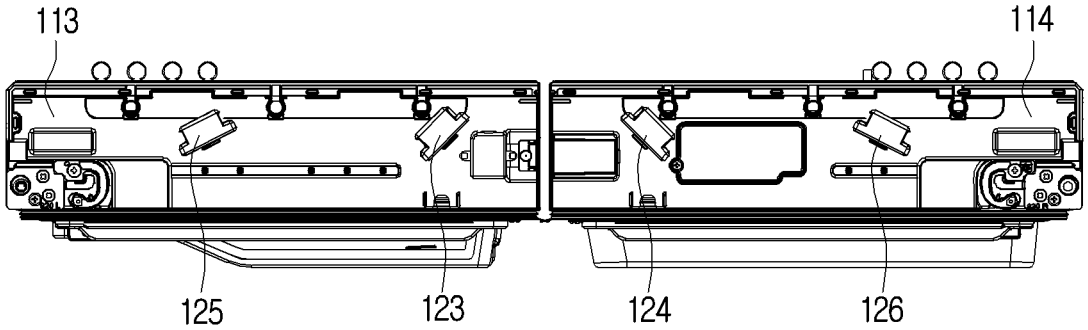
FIG. 14 is a bottom view of a third door and a fourth door according to an embodiment of the disclosure.

FIG. 14 is a bottom view of a third door and a fourth door according to an embodiment of the disclosure.

Referring to FIG. 14, the third proximity sensor 123 and the fifth proximity sensor 125 may be disposed on a bottom portion of the third door 113, and the fourth proximity sensor 124 and the sixth proximity sensor 126 may be disposed on a lower portion of the fourth door 114.

The sensing direction of at least two sensors may be different among the sensing direction of the third proximity sensor 123 to the sixth proximity sensor 126. The sensing direction may refer to the direction in which the proximity sensor faces the front surface of the refrigerator 100.

The third proximity sensor 123 may be rotated to the right by a third threshold angle toward the front surface of the refrigerator, the fourth proximity sensor 124 may be rotated to the left by a fourth threshold angle toward the front surface of the refrigerator 100, the fifth proximity sensor 125 may be rotated to the right by a fifth threshold angle toward the front surface of the refrigerator 100, and the sixth proximity sensor 126 may be rotated to the left by a sixth threshold angle toward the front surface of the refrigerator 100. Here, at least two of the third threshold angle to the sixth threshold angle may be different.

The refrigerator 100 according to an embodiment in which the threshold angle of the third proximity sensor 123 to the sixth proximity sensor 126 is differently arranged may sense a wider sensing area than the refrigerator 100 according to an embodiment using the same threshold angle.

Figure 15:
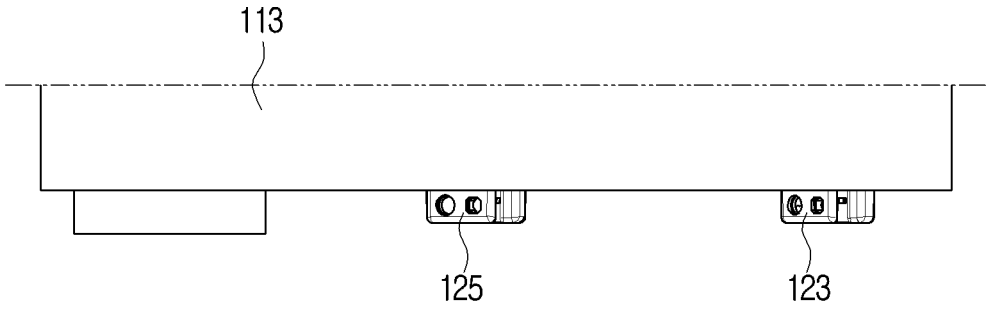
FIG. 15 is a front view of a third door according to an embodiment of the disclosure.

FIG. 15 is a front view of a third door according to an embodiment of the disclosure.

Referring to FIG. 15, the third proximity sensor 123 and the fifth proximity sensor 125 may be disposed on the lower portion of the third door 113. The third proximity sensor 123 and the fifth proximity sensor 125 may have different sensing directions. For example, the third proximity sensor 123 may be rotated to the right by a third threshold angle toward the front surface of the refrigerator 100, and the fifth proximity sensor 125 may be rotated to the right by a fifth threshold angle toward the front surface of the refrigerator 100.

According to one embodiment, the third threshold angle may be an angle greater than the fifth threshold angle. Since the central area of the front area of the refrigerator 100 may be sensed through the first proximity sensor 121 and the second proximity sensor 122, the third proximity sensor 123 and the fifth proximity sensor 125 may be arranged by rotating the sensing direction to sense the right area toward the front surface of the refrigerator 100 among the front area of the refrigerator 100. The reason why the fifth threshold angle should be greater than the third threshold angle is that, as the third proximity sensor 123 is disposed on the central portion of the refrigerator 100, the third proximity sensor 123 should be rotated at a greater angle than the fifth proximity sensor 125 to sense the right area toward the front surface of the refrigerator 100.

Although not shown, the fourth proximity sensor 124 and the sixth proximity sensor 126 may be disposed on the lower portion of the fourth door 114, and the fourth proximity sensor 124 and the sixth proximity sensor 126 may have different sensing directions from each other. For example, the fourth proximity sensor 124 may be rotated to the left by a fourth threshold angle toward the front surface of the refrigerator 100, and the sixth proximity sensor 126 may be rotated to the left by a sixth threshold angle toward the front surface of the refrigerator 100. The fourth threshold angle may be a value greater than the sixth threshold angle.

Figure 16:
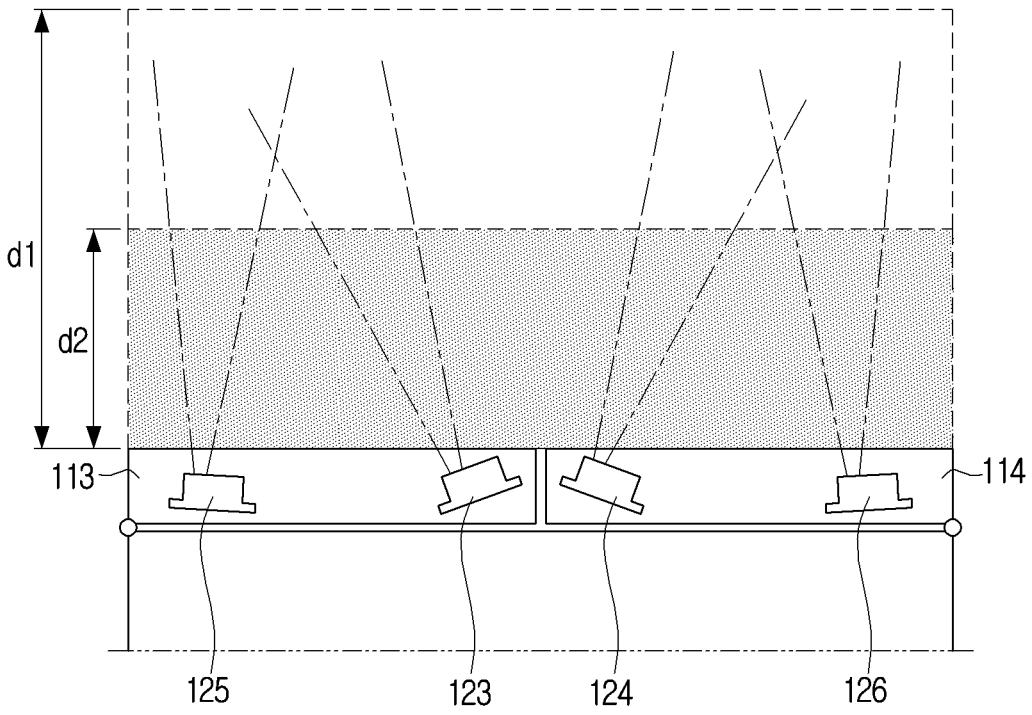
FIG. 16 is a bottom view of a third door and a fourth door according to an embodiment of the disclosure.

FIG. 16 is a bottom view of a third door and a fourth door according to an embodiment of the disclosure.

Referring to FIG. 16, the third proximity sensor 123 to the sixth proximity sensor 126 may have different sensing directions. If the sensing direction is controlled differently, the refrigerator 100 may precisely identify the external object with respect to the dangerous area and the sensing area.

According to an embodiment, the third proximity sensor 123 and the fifth proximity sensor 125 may be disposed such that a sensing area which may be sensed by the third proximity sensor 123 and a sensing area which may be sensed by the fifth proximity sensor 125 are partially overlapped.

According to another embodiment, the third proximity sensor 123 and the fifth proximity sensor 125 may be disposed so that the sensing area capable of sensing the third proximity sensor 123 and the sensing area capable of sensing the fifth proximity sensor 125 do not overlap.

Although the refrigerator 100 according to an embodiment has a reduced sensing area than the refrigerator 100, a precise analysis may be possible. Since the area detecting the external object may be partially overlapped, the sensing data obtained from the third proximity sensor 123 and the sensing data obtained from the fifth proximity sensor 125 may be combined and analyzed.

Figure 17:
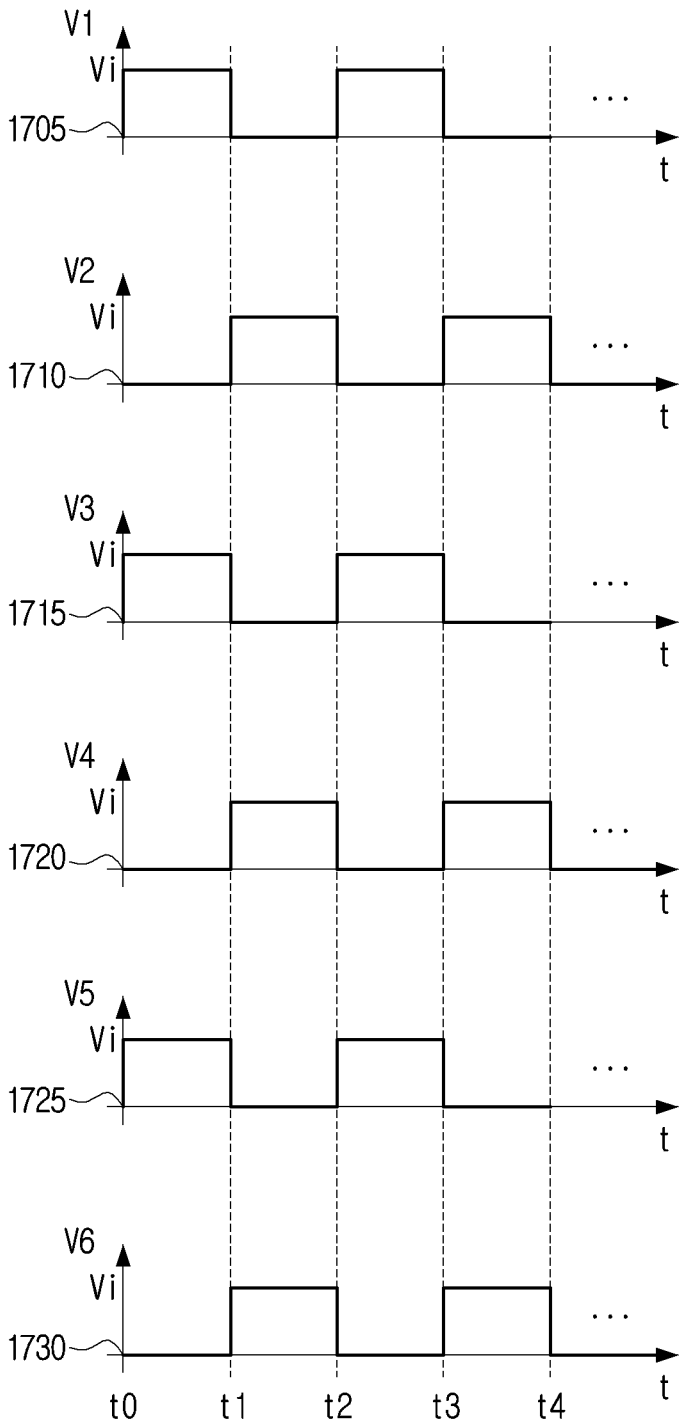
FIG. 17 is a diagram illustrating an alternate control operation of a refrigerator according to an embodiment of the disclosure.

FIG. 17 is a diagram illustrating an alternate control operation of a refrigerator according to an embodiment of the disclosure.

Referring to FIG. 17, graphs 1705, 1710, 1715, 1720, 1725, 1730 may refer to applied voltage over time of respective proximity sensors 121, 122, 123, 124, 125, 126.

The v4 may refer to the voltage applied to the fourth proximity sensor 124, and v6 may refer to the voltage applied to the sixth proximity sensor 126. The above description is the same as that of FIGS. 7 and 12, and thus a redundant description will be omitted.

When the first proximity sensor 121, the third proximity sensor 123, and the fifth proximity sensor 125 are turned on from 0 to t1, the second proximity sensor 122, the fourth proximity sensor 124, and the sixth proximity sensor 126 may control proximity sensors to be turned off. When the first proximity sensor 121, the third proximity sensor 123, and the fifth proximity sensor 125 are turned off from t1 to t2, the refrigerator 100 may control proximity sensors such that the second proximity sensor 122, the fourth proximity sensor 124, and the sixth proximity sensor 126 are turned on. When the first proximity sensor 121, the third proximity sensor 123, and the fifth proximity sensor 125 are turned on from t2 to t3, the refrigerator 100 may control the proximity sensors such that the second proximity sensor 122, the fourth proximity sensor 124, and the sixth proximity sensor 126 are turned off. When the first proximity sensor 121, the third proximity sensor 123, and the fifth proximity sensor 125 are turned off from t3 to t4, the refrigerator 100 may control proximity sensors such that the second proximity sensor 122, the fourth proximity sensor 124, and the sixth proximity sensor 126 are turned on.

Figure 18:
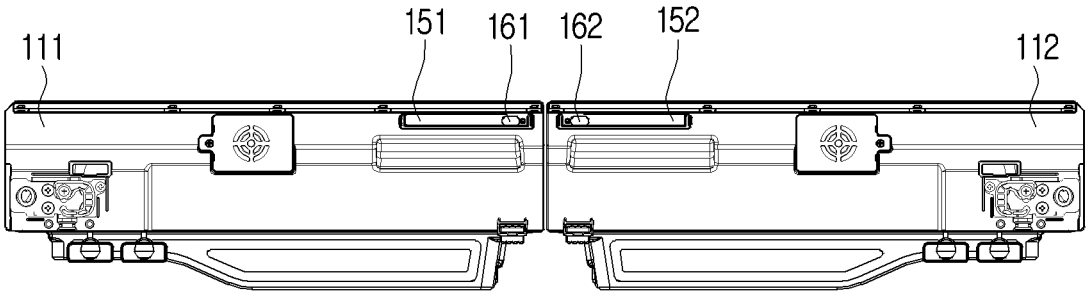
FIG. 18 is a bottom view of a first door and a second door according to an embodiment of the disclosure.

FIG. 18 is a bottom view of a first door and a second door according to an embodiment of the disclosure.

Referring to FIG. 18, at least one of the first light emitter 151 or the first infrared sensor 161 may be disposed on the first door 111. At least one of the second light emitter 152 or the second infrared sensor 162 may be disposed on the second door 112.

At least one of the first light emitter 151 or the first infrared sensor 161 may be disposed on a lower portion of the first door 111. Here, at least one of the first light emitter 151 or the first infrared sensor 161 may be disposed in the right edge area of the lower portion of the first door 111 (the left edge area facing the front surface of the refrigerator 100).

At least one of the second light emitter 152 or the second infrared sensor 162 may be disposed on the lower portion of the second door 112. At least one of the second light emitter 152 or the second infrared sensor 162 may be disposed in the right edge area of the lower surface of the second door 112 (right edge area toward the front surface of the refrigerator 100).

Figure 19:
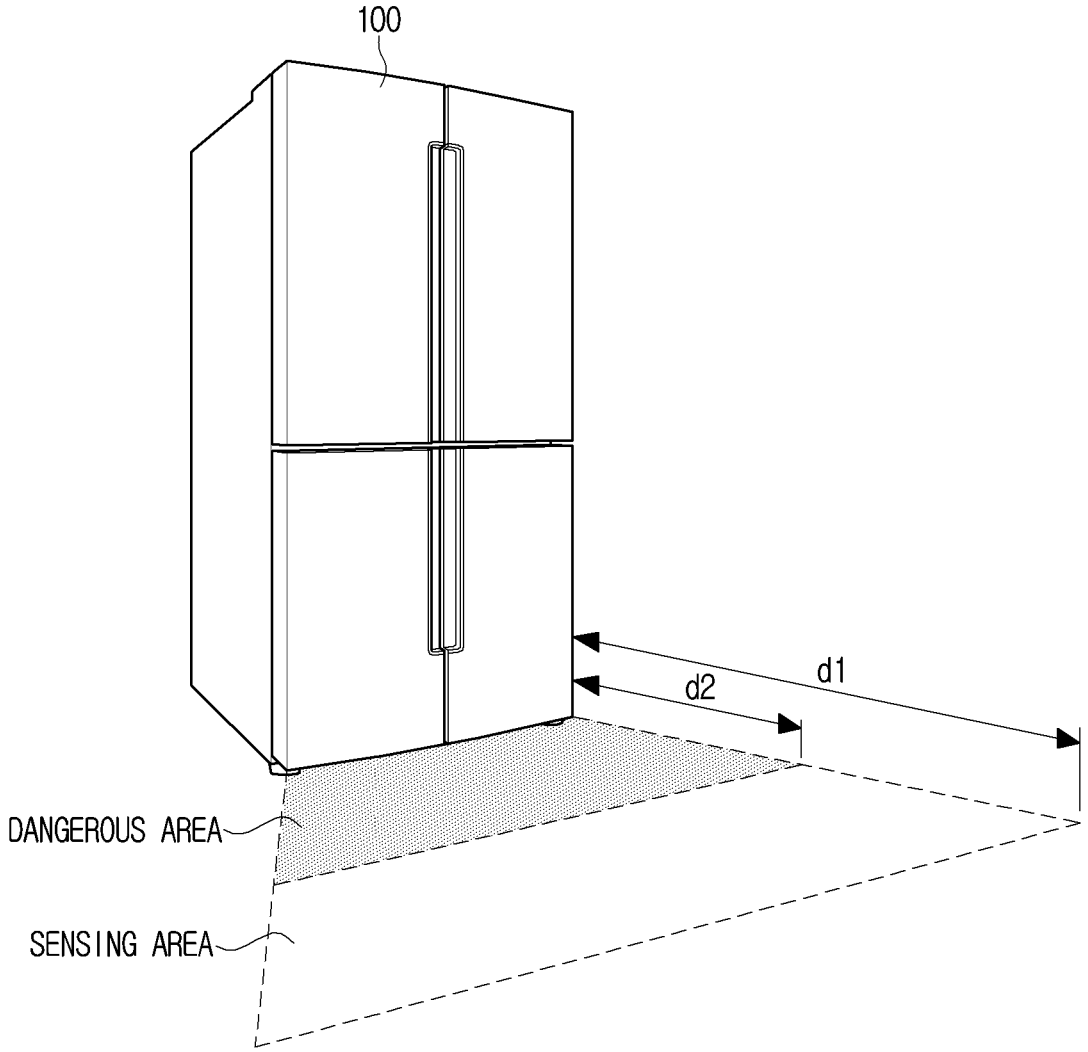
FIG. 19 is a diagram illustrating a sensing area of a refrigerator according to an embodiment of the disclosure.

FIG. 19 is a diagram illustrating a sensing area of a refrigerator according to an embodiment of the disclosure.

Referring to FIG. 19, the refrigerator 100 may detect whether the external object is identified in the predetermined area based on sensing data obtained through the proximity sensor. The predetermined area may vary depending on the user's setting.

According to an embodiment, the refrigerator 100 may identify an area corresponding to an area between a distance d1 from the refrigerator 100 to a first threshold distance and a distance d2 from the refrigerator 100 to a second threshold distance as a sensing area. The refrigerator 100 may identify an area corresponding to a distance d2 from the refrigerator 100 to a second threshold distance as a dangerous area. The dangerous area may be a product liability area. The product liability area may refer to an area where a user using a manufactured product may be damaged during an essential operation of a manufactured product.

According to another embodiment, the refrigerator 100 may identify the distance d1 from the refrigerator 100 to a first threshold distance as a sensing area, and identify an area corresponding to a distance d2 from the refrigerator 100 to a second threshold distance as a dangerous area.

The difference between the embodiment and another embodiment may be about which area is set as the sensing area. In one embodiment, the dangerous area does not correspond to the sensing area, but in other embodiments, the dangerous area may be included in the sensing area. If it is assumed that a person has approached a dangerous area directly, in one embodiment, an external object may be identified as not approaching, and in other embodiments the external object may be identified as approaching.

Figure 20:
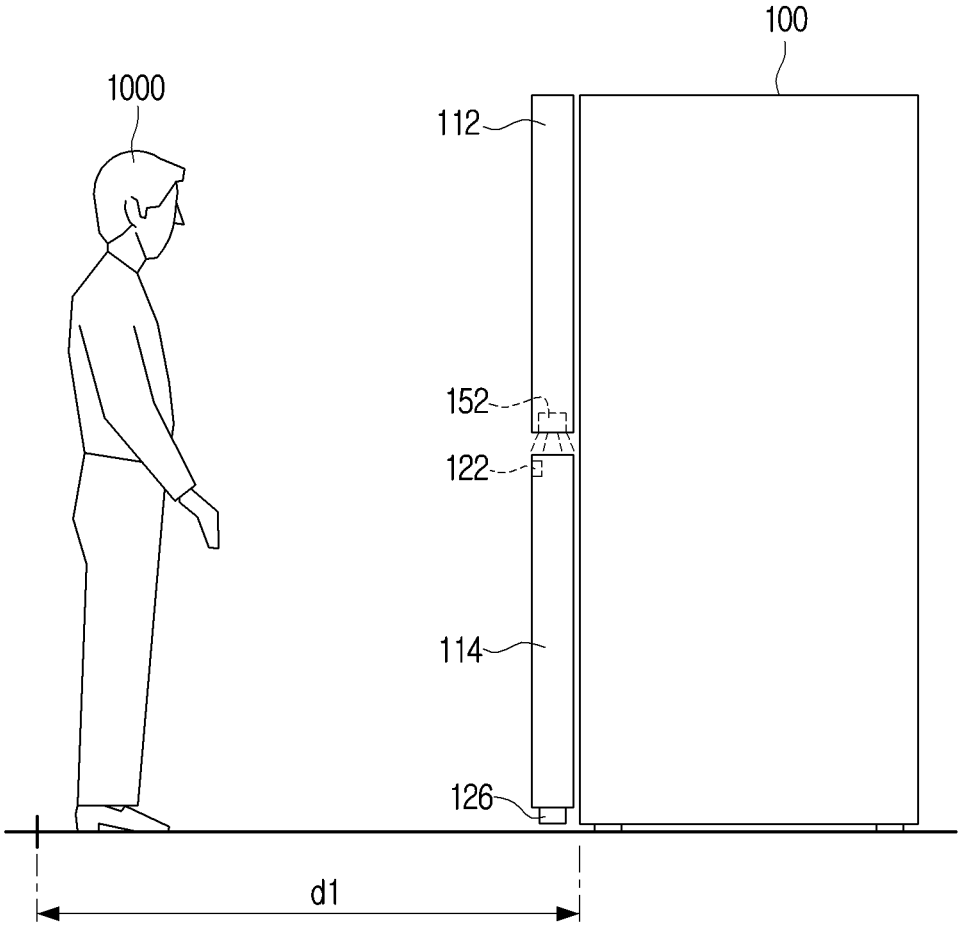
FIG. 20 is a diagram illustrating a door opening operation of a refrigerator according to an embodiment of the disclosure.

FIG. 20 is a diagram illustrating a door opening operation of a refrigerator according to an embodiment of the disclosure.

Referring to FIG. 20, the refrigerator 100 may further include a first light emitter 151 and a second light emitter 152.

The refrigerator 100 may identify whether an external object exists in the sensing area. The sensing region may be divided into an upper sensing area and a lower sensing area. The upper sensing area may refer to area identifiable by the first proximity sensor 121 and the second proximity sensor 122. The lower sensing area may refer to an area identifiable by the third proximity sensor 123 to the sixth proximity sensor 126.

It is assumed that the sensing area is from the refrigerator 100 to the threshold distance d1. The refrigerator 100 may identify whether an external object 1000 exists in a sensing area based on sensing data obtained from at least one of the first proximity sensor 121 to the sixth proximity sensor 126. When the external object 1000 exists in the sensing area, the refrigerator 100 may control the first light emitter 151 and the second light emitter 152 to operate in the first light emitting mode. The first light emitting mode may be a mode (or a mode of turning on the light-emitter) that emits light with the same illuminance.

In a state where light is not output through the light emitter, light is output in a first light emitting mode, the user may easily recognize that the door opening has not been performed.

Figure 21:
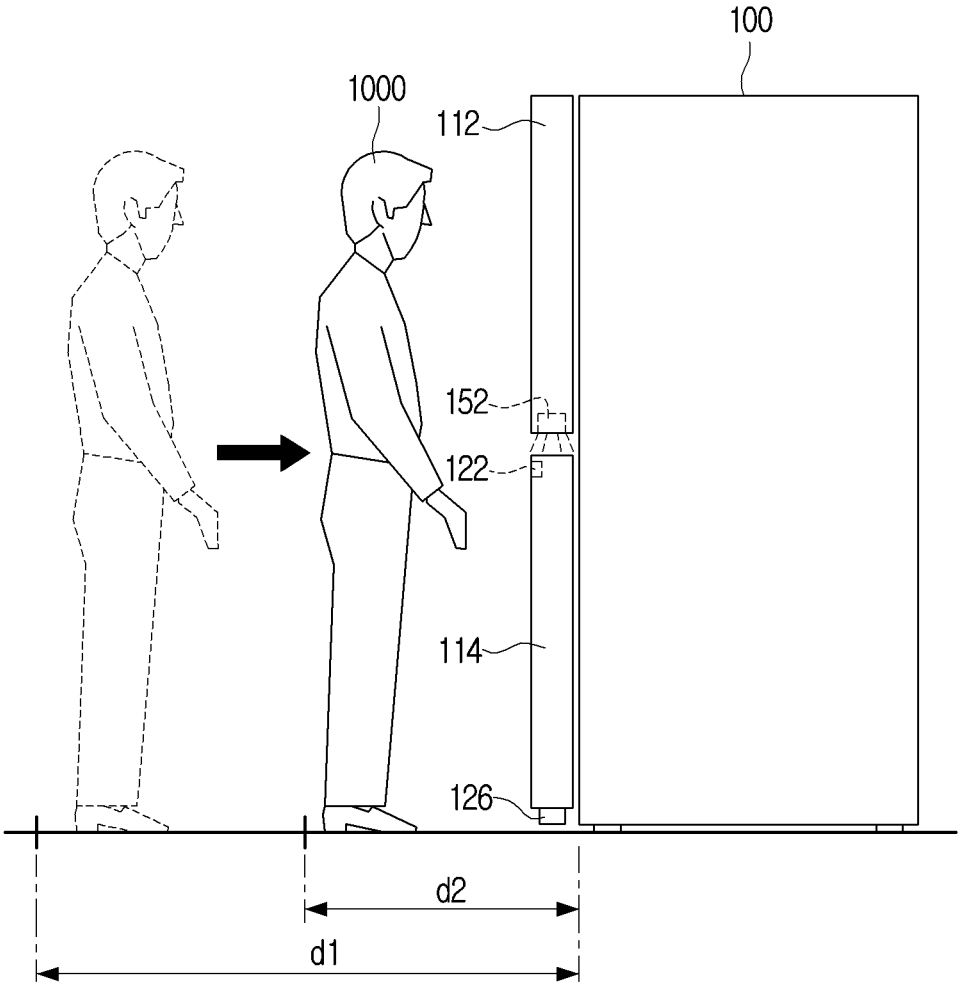
FIG. 21 is a diagram illustrating a subsequent operation of a door opening operation of FIG. 20 according to an embodiment of the disclosure.

FIG. 21 is a diagram illustrating a subsequent operation of a door opening operation of FIG. 20 according to an embodiment of the disclosure.

Referring to FIG. 21, the refrigerator 100 may identify that the external object 1000 exists in a sensing area and may control the first light emitter 151 and the second light emitter 152 to operate in the first light emitting mode, and then, based on sensing data obtained from at least one of the first proximity sensor 121 to the sixth proximity sensor 126, the refrigerator 100 may identify whether the external object 1000 exists in the dangerous area.

The dangerous area may be divided into an upper dangerous area and a lower dangerous area. The upper dangerous area may refer to an area detectable by the first proximity sensor 121 and the second proximity sensor 122, and the lower dangerous area may refer to an area detectable by the third proximity sensor 123 to the sixth proximity sensor 126.

The dangerous area may be an area from the refrigerator 100 to the threshold distance d2. If the external object 1000 exists in the dangerous area, the refrigerator 100 may control the at least one light emitter so that at least one light emitter of the first light emitter 151 or the second light emitter 152 operates in the second light emitting mode. The second light emitting mode may be in a light emitting mode.

As light may be output in a second light emitting mode which is different from the first light emitting mode, the user may easily recognize that the automatic door opening has not been performed.

Figure 22:
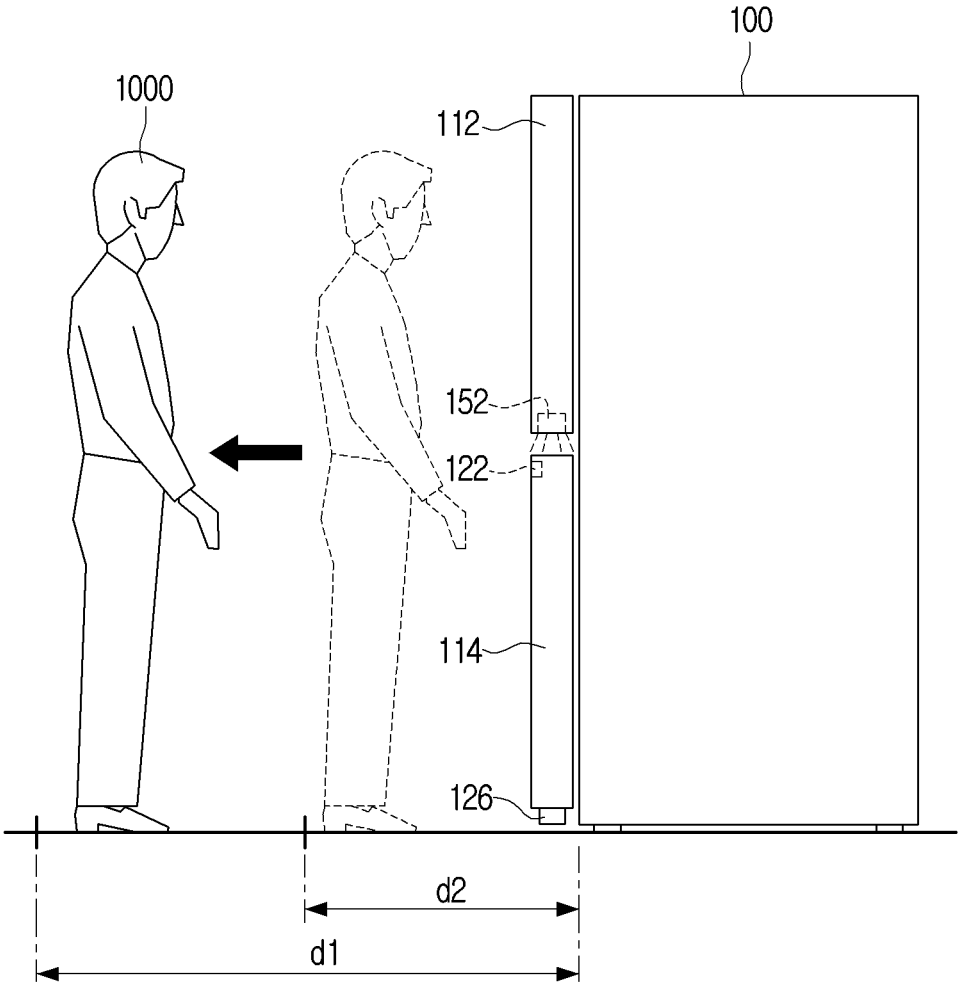
FIG. 22 is a diagram illustrating a subsequent operation of a door opening operation of FIG. 21 according to an embodiment of the disclosure.

FIG. 22 is a diagram illustrating a subsequent operation of a door opening operation of FIG. 21 according to an embodiment of the disclosure.

Referring to FIG. 22, when the external object 1000 is identified in the dangerous area after the external object 1000 has been identified in the sensing area, the refrigerator 100 may identify whether the external object 1000 exists in the dangerous area again. If the external object 1000 does not exist in the dangerous area, the refrigerator 100 may control at least one of the first door 111 or the second door 112 to be opened.

Figure 23:
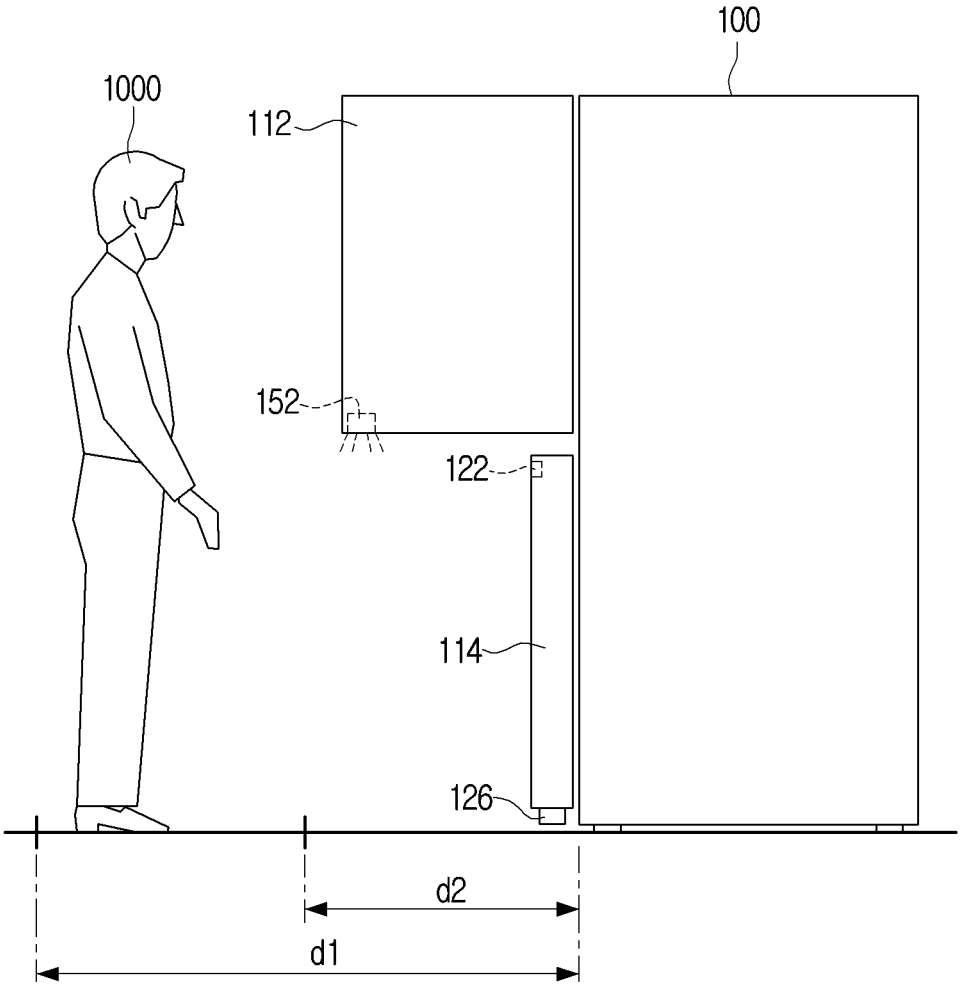
FIG. 23 is a diagram illustrating a subsequent operation of a door opening operation of FIG. 22 according to an embodiment of the disclosure.

FIG. 23 is a diagram illustrating a subsequent operation of a door opening operation of FIG. 22 according to an embodiment of the disclosure.

Referring to FIG. 23, the refrigerator 100 may control at least one of the first door 111 or the second door 112 to be automatically opened based on a predetermined event. The predetermined event may refer to an event that the external object 1000 is identified in the sensing area, and the external object 1000 is identified in the dangerous area after the external object 1000 is identified in the sensing area, and the external object 1000 is not identified in the dangerous area after the external object 1000 is identified in the dangerous area. That the external object 1000 is not identified in the dangerous area after the external object 1000 has been identified in the dangerous area may mean that the external object 1000 approaches and then away from the refrigerator 100.

The refrigerator 100 may control the door opening device 130 to automatically open at least one of the first door 111 or the second door 112 based on the predetermined event.

The refrigerator 100 may control at least one light emitter such that at least one light emitter of the first light emitter 151 or the second light emitter 152 operates in the third light emitting mode from the second light emitting mode again based on a predetermined event.

The third light emitting mode may refer to a mode different from the first light emitting mode and the second light emitting mode. For example, the third light emitting mode may be a mode where light having a color different from the first light emitting mode may be output at a predetermined illuminance while outputting light with a predetermined illuminance, such as the first light emitting mode. As another example, the third light emitting mode may be a mode in which light may be output at a different speed than the second light emitting mode while outputting the light to be flicking, such as the second light emitting mode.

As the light may be output in the third light emitting mode different from the first light emitting mode and the second light emitting mode, the user may easily recognize that the operation of automatically opening the door of the refrigerator 100 has been performed.

Figure 24:
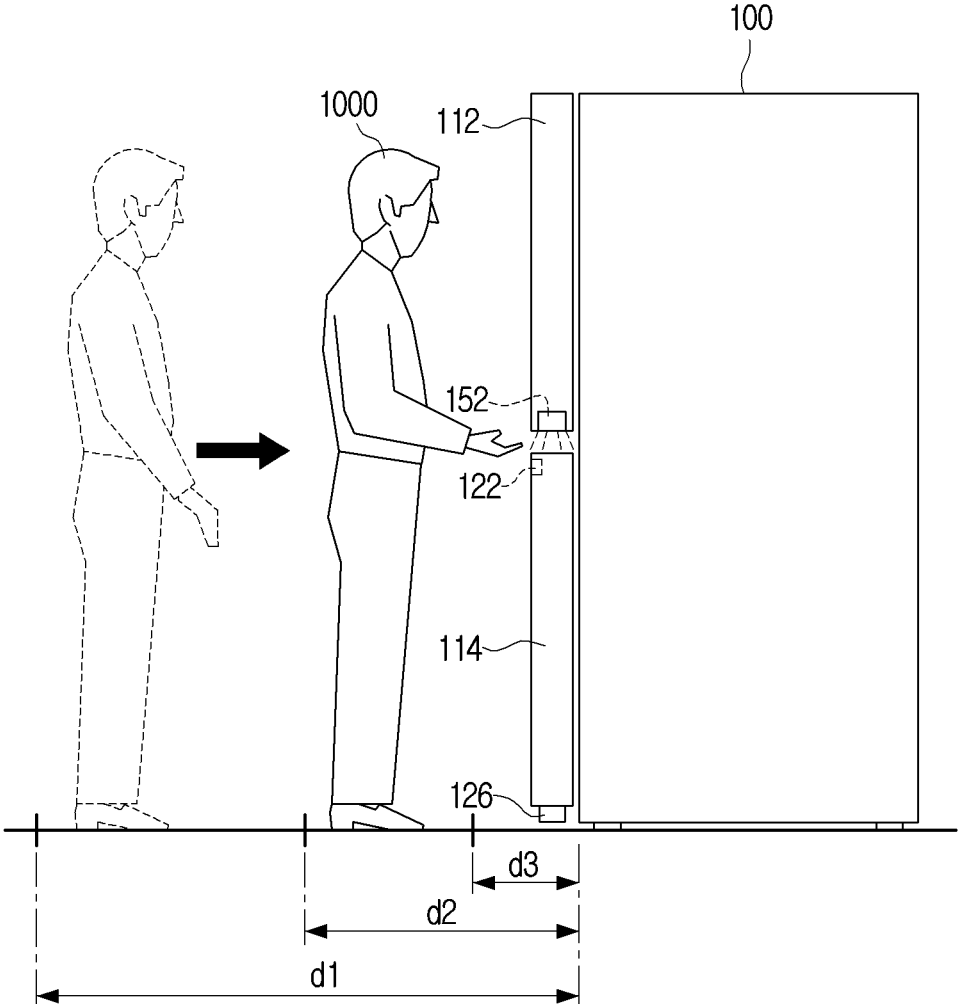
FIG. 24 is a diagram illustrating a door opening operation of a refrigerator according to an embodiment of the disclosure.

FIG. 24 is a diagram illustrating a door opening operation of a refrigerator according to an embodiment of the disclosure.

Referring to FIG. 24, the refrigerator 100 may control the door to be automatically opened based on the predetermined event.

The predetermined event may be made of three operations.

As the first operation, the refrigerator 100 may determine whether the external object 1000 is identified in the sensing area (area from the refrigerator 100 to d1).

In the second operation, when the external object 1000 is identified in the sensing area, the refrigerator 100 may determine whether the external object 1000 is identified in a trigger area. The trigger area may mean a region from the refrigerator 100 to the d3. In general, if the user performs an action of extending the hand or foot, the proximity sensor may recognize the action and identify that the external object 1000 is present in the trigger area.

In the third operation, the refrigerator 100 may determine whether the external object 1000 is not identified in the trigger area when the external object 1000 is identified in the trigger area. If the external object 1000 is identified in the trigger area, the refrigerator 100 may determine that the door is not opened. When the external object 1000 is identified in the trigger area and then the external object 1000 is not identified in the trigger area, the refrigerator 100 may control the door opening device 130 to automatically open at least one of the first door 111 or the second door 112.

In determining whether the external object 1000 is identified in the trigger area, the refrigerator 100 may use at least one sensor of the first proximity sensor 121 or the second proximity sensor 122, and the first proximity sensor 121 and the second proximity sensor 122 may be disposed above a predetermined threshold height. The refrigerator 100 may determine whether the external object 1000 is identified in the trigger area by using only one sensor of the first proximity sensor 121 or the second proximity sensor 122 without using the third proximity sensor 123 to the sixth proximity sensor 126 with respect to the final event for automatic door opening.

In a situation where the door is automatically opened based on a predetermined event, the refrigerator 100 may determine whether the external object 1000 is identified in the dangerous area. When the external object 1000 is identified in the dangerous area when the door is automatically opened, the refrigerator 100 may control the door opening device 130 to stop opening the door. When the automatic opening operation is not recognized by the user and when the user is located near the refrigerator 100, the user may be protected by automatically stopping the opening operation.

Figure 25:
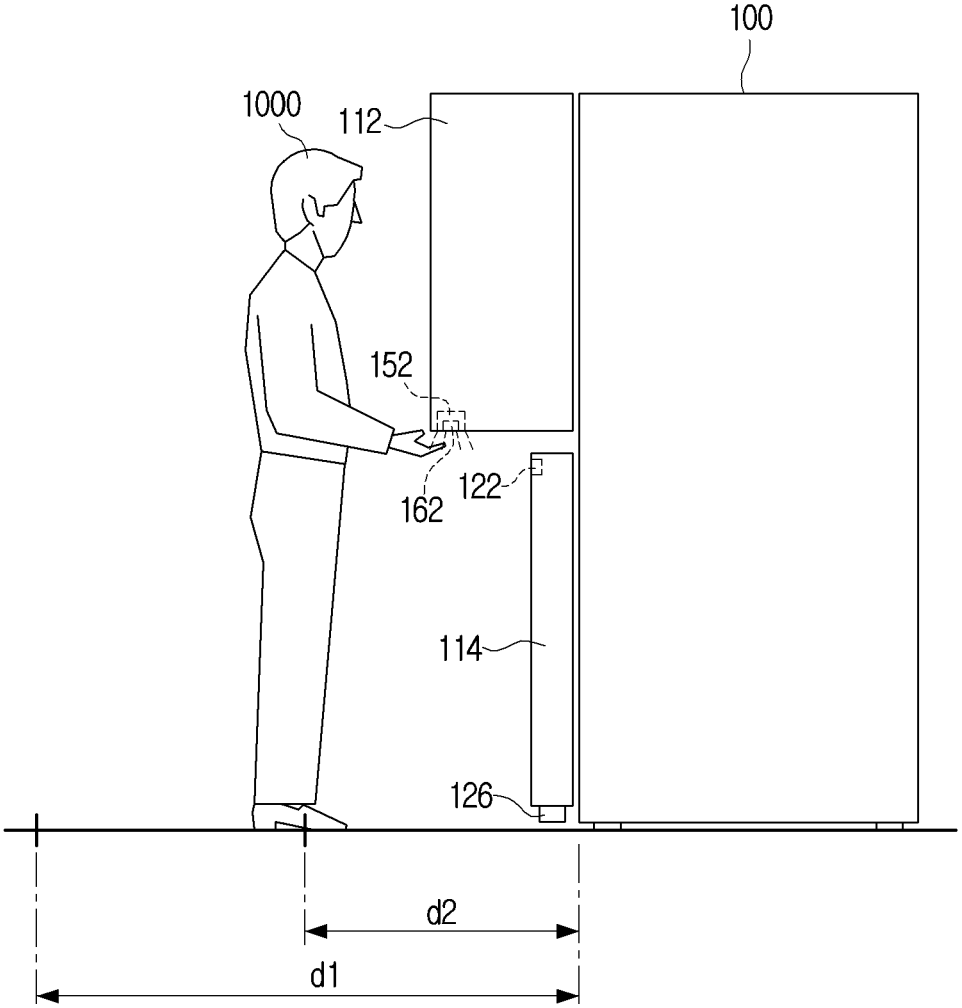
FIG. 25 is a diagram illustrating a control operation of a refrigerator according to an embodiment of the disclosure.

FIG. 25 is a diagram illustrating a control operation of a refrigerator according to an embodiment of the disclosure.

Referring to FIG. 25, the refrigerator 100 may control the door opening device 130 to automatically open at least one of the first door 111 or the second door 112 based on the predetermined event.

The second light emitter 152 and the second infrared sensor 162 may be disposed on the second door 112. When the external object 1000 is sensed through the second infrared sensor 162, the refrigerator 100 may control the door opening device 130 so that the second door 112 is not opened.

Similarly, the first light emitter 151 and the first infrared sensor 161 may be disposed on the first door 111. When the external object 1000 is sensed through the first infrared sensor 161, the refrigerator 100 may control the door opening device 130 so that the first door 111 is not opened.

The embodiment may be applied to the operation of opening at least one of the first door 111 or the second door 112 by the control of the refrigerator 100. For example, when the external object 1000 is sensed through the second infrared sensor 162 while the second door 112 is opened based on a predetermined event, the refrigerator 100 may control the door opening device 130 so that the second door 112 is not opened.

The situation where the infrared sensor detects the external object 1000 may refer to a situation where the external object 1000 stretches the hand to grab a handle (knob) of a door or pushes the hand near the handle (knob).

Figure 26:
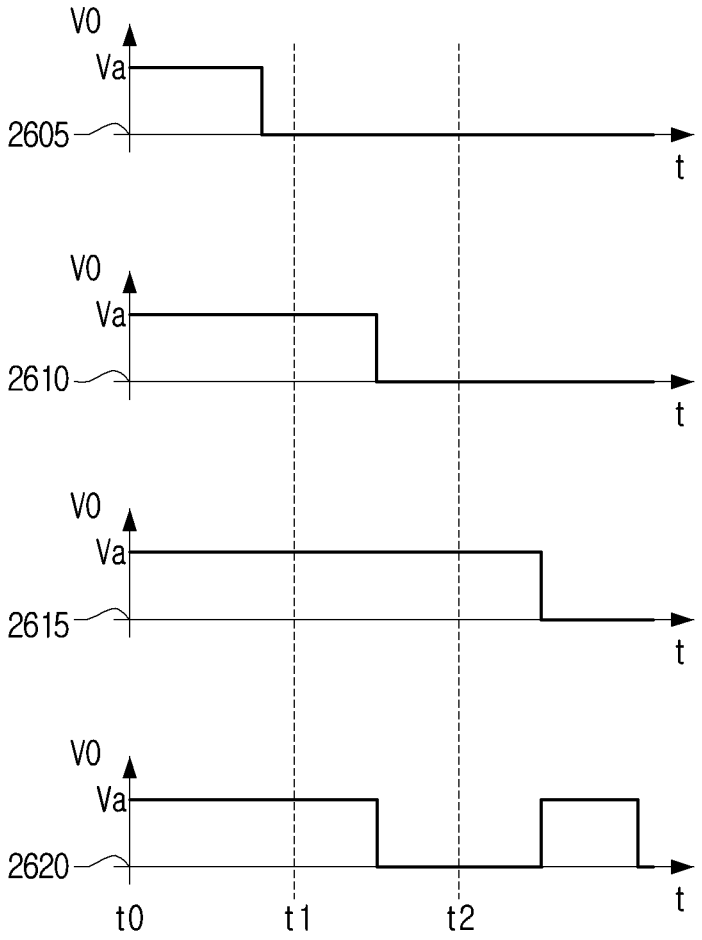
FIG. 26 is a diagram illustrating a control operation of a refrigerator according to an embodiment of the disclosure.

FIG. 26 is a diagram illustrating a control operation of a refrigerator according to an embodiment of the disclosure.

Referring to FIG. 26, the proximity sensor may have various sensing values depending on whether an external object approaches or not. Here, the criteria of sensing are assumed as voltage VO. When external object is sensed, Va value may be output, and when the external object is not sensed a value of 0 may be output.

According to an embodiment 2605, the external object may not be sensed at the time point t0 by the proximity sensor and no longer sensed prior to t1. The refrigerator 100 may control the door opening device 130 so as not to open the door.

According to another embodiment 2610, an external object may be sensed at a time point t0 by the proximity sensor and no longer sensed prior to t2 time point after t1. The refrigerator 100 may control the door opening device 130 to open the door.

According to another embodiment 2615, an external object may be sensed at a time point t0 by the proximity sensor and no longer sensed after the t2 time point. The refrigerator 100 may control the door opening device 130 so as not to open the door.

According to another embodiment 2620, an external object may be sensed at a time point t0 by the proximity sensor and no longer sensed prior to a t2 time point after a t1 time point, and an external object may be sensed again after the t2 time point. The refrigerator 100 may control the door opening device 130 to open the door, and stop the opening of the door which is being opened when the external object is sensed again after the t2 time point.

Figure 27:
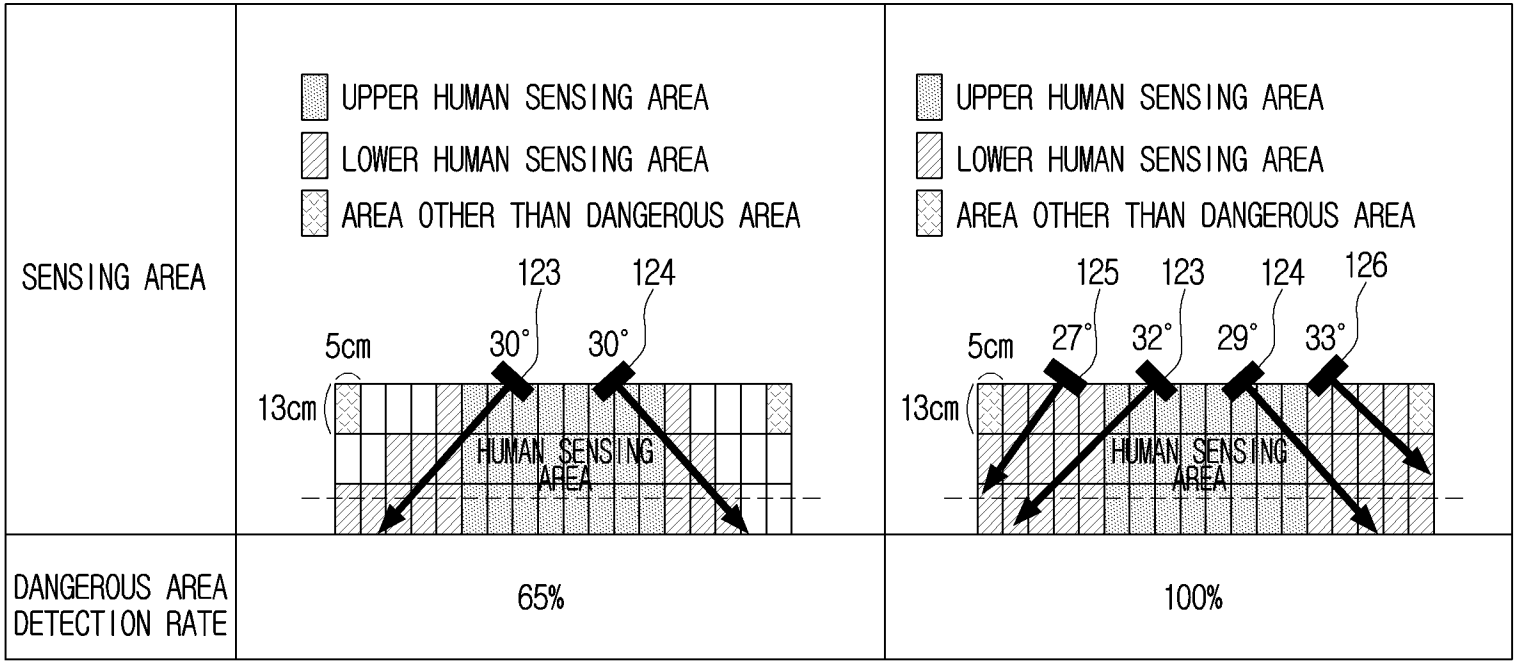
FIG. 27 is a diagram illustrating a dangerous area detection rate according to disposition of a proximity sensor of a refrigerator according to an embodiment of the disclosure.

FIG. 27 is a diagram illustrating a dangerous area detection rate according to disposition of a proximity sensor of a refrigerator according to an embodiment of the disclosure.

Referring to FIG. 27, the first proximity sensor 121 may be disposed on the first door 111 and the second proximity sensor 122 may be disposed on the second door 112, and the disposition direction may be the same.

According to an embodiment, a third proximity sensor 123 may be disposed on a lower portion of the third door 113, and a fourth proximity sensor 124 may be disposed on a lower portion of the fourth door 114. The third proximity sensor 123 may be rotated to the right side by 30 degrees toward the front surface of the refrigerator 100. The fourth proximity sensor 124 may be rotated to the left by 30 degrees toward the front surface of the refrigerator 100. The dangerous zone detection rate of the refrigerator 100 according to an embodiment may be 65%.

According to another embodiment, the third proximity sensor 123 and the fifth proximity sensor 125 may be disposed on the lower portion of the third door 113, and the fourth proximity sensor 124 and the sixth proximity sensor 126 may be disposed on the lower portion of the fourth door 114. The third proximity sensor 123 may be rotated to the right side by 32 degrees toward the front surface of the refrigerator 100. The fourth proximity sensor 124 may be rotated to the left by 29 degrees toward the front surface of the refrigerator 100. The fifth proximity sensor 125 may be rotated to the right by 27 degrees toward the front surface of the refrigerator 100. The sixth proximity sensor 126 may be rotated to the left by 33 degrees toward the front surface of the refrigerator 100. The risk area detection rate of the refrigerator 100 according to another embodiment may be 100%.

In general, the refrigerator 100 may determine whether the external object 1000 is identified in the upper sensing area by using the first proximity sensor 121 and the second proximity sensor 122. The refrigerator 100 may determine whether the external object 1000 is identified in the lower detection area by using at least two sensors among the third proximity sensor 123 to the sixth proximity sensor 126.

According to an embodiment, the refrigerator 100 according to another embodiment may sense a dangerous area by using a greater number of proximity sensors. Therefore, the risk detection rate of the refrigerator 100 according to another embodiment may be higher.

Unlike the refrigerator 100 according to an embodiment, the refrigerator 100 according to another embodiment may have a different arrangement direction of each proximity sensor. According to the proximity sensor arrangement according to an embodiment, the third proximity sensor 123 and the fourth proximity sensor 124 are rotated to the left or right at the same angle, but the position of the light emitter 121-1 included in the proximity sensor is disposed on further left side than the position of the light receiver 121-2, so that the range of detecting dangerous area of left side and right side may be different. In order to overcome this disadvantage, proximity sensors may be disposed so that the angle at which the sixth proximity sensor 126 is rotated is larger than the angle at which the fourth proximity sensor 124 is rotated.

Figure 28:
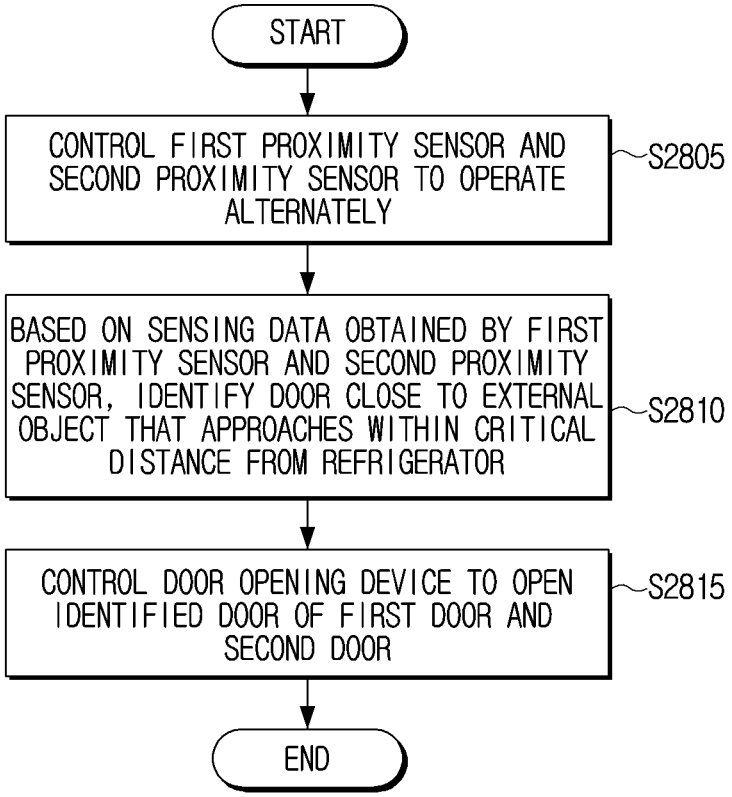
FIG. 28 is a flowchart of a control method of a refrigerator according to an embodiment of the disclosure.

FIG. 28 is a flowchart of a control method of a refrigerator according to an embodiment of the disclosure.

Referring to FIG. 28, a control method of the refrigerator 100 including a main body 110 including a first door 111 and a second door 112, a door opening device 130 to open the first door 111 and the second door 112, a first proximity sensor 121 disposed adjacent to the first door 111, and a second proximity sensor 122 disposed adjacent to the second door 112 may include controlling the first proximity sensor 121 and the second proximity sensor 122 to operate alternately in operation 52805.

The control method may include, based on sensing data obtained by the first proximity sensor 121 and the second proximity sensor 122, identifying a door close to an external object that approaches within a threshold distance from the refrigerator 100 in operation 52810.

The control method may include controlling the door opening device 130 to open the identified door of the first door 111 and the second door 112 in operation S2815.

The main body 10 may further include a third door 113 disposed below the first door 111 and a fourth door 114 disposed below the second door 112, and the first proximity sensor 121 may be disposed on the third door 113, and the second proximity sensor 122 may be disposed on the fourth door 114.

The refrigerator 100 may further include a first light emitter 151 disposed on the first door 111 and a second light emitter 152 disposed on the second door 112, and the method may further include identifying information about an approach distance of the external object and controlling at least one of the first light emitter 151 or the second light emitter 152 based on the identified information about an approach distance.

The controlling at least one of the first light emitter 151 or the second light emitter 152 may include, based on the external object approaching within a first threshold distance, turning on at least one of the first light emitter 151 or the second light emitter 152, and based on the external object approaching within a second threshold distance that is shorter than the first threshold distance, controlling a light emitter disposed on the identified door of the first light emitter 151 or the second light emitter 152 to flicker.

The control method of the refrigerator 100 may further include, based on identifying that the external object is positioned within the second threshold distance for a first threshold time, and then moves out of the second threshold distance, controlling the door opening device 13 to open the identified door and based on identifying the external object in excess of a second threshold time greater than the first threshold time within the second threshold distance, controlling the door opening device 130 not to open the identified door.

The refrigerator 100 may further include an outputter and the method may further include, based on the external object being identified in excess of the second threshold time within the second threshold distance, outputting guide information through the outputter.

The refrigerator 100 may further include a third proximity sensor 123 disposed on the third door 113 and a fourth proximity sensor 124 disposed on the fourth door 114, and the method may further include controlling the third proximity sensor 123 and the fourth proximity sensor 124 to operate alternately.

The control method of the refrigerator 100 may further include, based on identifying that an external object exists in a predetermined area corresponding to the third proximity sensor 123 while the first door 111 is opened, controlling the door opening device 130 to stop opening of the first door 111 and based on identifying that an external object exists in a predetermined area corresponding to the fourth proximity sensor 124 while the second door 112 is opened, controlling the door opening device 130 to stop opening of the second door 112.

The control method of the refrigerator 100 may further include turning off the second proximity sensor 122 and the fourth proximity sensor 124 while the first proximity sensor 121 and the third proximity sensor 123 are turned on and turning off the second proximity sensor 122 and the fourth proximity sensor 124 while the first proximity sensor 121 and the third proximity sensor 123 are turned off.

The control method of the refrigerator 100 as shown in FIG. 28 may be performed on the refrigerator 100 having the configuration of FIG. 1 or FIG. 2, and may be executed on the refrigerator 100 having other configurations.

The methods according to various embodiments of the disclosure may be implemented as a format of software or application installable to a related art electronic device.

The methods according to various embodiments of the disclosure may be implemented by software upgrade of a related art electronic device (refrigerator), or hardware upgrade only.

The various embodiments as described above may be implemented through an external server of at least one of a display device and an electronic device (refrigerator), or an embedded server provided in an electronic device (refrigerator).

Meanwhile, various embodiments of the disclosure may be implemented in software, including instructions stored on machine-readable storage media readable by a machine (e.g., a computer). An apparatus may call instructions from the storage medium, and execute the called instruction, including an electronic apparatus (for example, refrigerator) according to the disclosed embodiments. When the instructions are executed by a processor, the processor may perform a function corresponding to the instructions directly or by using other components under the control of the processor. The instructions may include a code generated by a compiler or a code executable by an interpreter. A machine-readable storage medium may be provided in the form of a non-transitory storage medium. Herein, the term "non-transitory" only denotes that a storage medium does not include a signal but is tangible, and does not distinguish the case in which a data is semi-permanently stored in a storage medium from the case in which a data is temporarily stored in a storage medium.

According to an embodiment, the method according to the above-described embodiments may be provided as being included in a computer program product. The computer program product may be traded as a product between a seller and a consumer. The computer program product may be distributed online in the form of machine-readable storage media (e.g., compact disc read only memory (CD-ROM)) or through an application store (e.g., Play Store™ and App Store™) or distributed online (e.g., downloaded or uploaded) directly between to users (e.g., smartphones). In the case of online distribution, at least a portion of the computer program product may be at least temporarily stored or temporarily generated in a server of the manufacturer, a server of the application store, or a machine-readable storage medium such as memory of a relay server.

According to the embodiments, the respective elements (e.g., module or program) of the elements mentioned above may include a single entity or a plurality of entities. According to the embodiments, at least one element or operation from among the corresponding elements mentioned above may be omitted, or at least one other element or operation may be added. Alternatively or additionally, a plurality of components (e.g., module or program) may be combined to form a single entity. In this case, the integrated entity may perform functions of at least one function of an element of each of the plurality of elements in the same manner as or in a similar manner to that performed by the corresponding element from among the plurality of elements before integration. The module, a program module, or operations executed by other elements according to variety of embodiments may be executed consecutively, in parallel, repeatedly, or heuristically, or at least some operations may be executed according to a different order, may be omitted, or the other operation may be added thereto.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A refrigerator comprising:

a main body including a first door and a second door;

a door opening device comprising a module for opening the first door and the second door;

a first proximity sensor disposed adjacent to the first door;

a second proximity sensor disposed adjacent to the second door; and a processor, wherein the processor is configured to:

control the first proximity sensor and the second proximity sensor to operate alternately, based on sensing data obtained by the first proximity sensor and the second proximity sensor, identify a door close to an external object that approaches within a threshold distance from the refrigerator, and transmit to the door opening device a signal for opening the identified door among the first door and the second door.

2. The refrigerator of claim 1, wherein the main body further comprises a third door disposed below the first door and a fourth door disposed below the second door, wherein the first proximity sensor is disposed on the third door, and wherein the second proximity sensor is disposed on the fourth door.

3. The refrigerator of claim 2, further comprising:

a first light emitter disposed on the first door; and a second light emitter disposed on the second door, wherein the processor is further configured to:

identify information about an approach distance of the external object, and transmit a signal for turning on at least one of the first light emitter or the second light emitter based on the identified information about an approach distance.

4. The refrigerator of claim 3, wherein the processor is further configured to:

based on the external object approaching within a first threshold distance, transmit a signal for turning on at least one of the first light emitter or the second light emitter, the first light emitter and the second light emitter comprising at least one light emitting element, and based on the external object approaching within a second threshold distance that is shorter than the first threshold distance, transmit to a light emitter disposed on the identified door of the first light emitter or the second light emitter to flicker.

5. The refrigerator of claim 4, wherein the processor is further configured to:

based on identifying that the external object is positioned within the second threshold distance for a first threshold time, and then moves out of the second threshold distance, control the door opening device to open the identified door, and based on identifying the external object in excess of a second threshold time greater than the first threshold time within the second threshold distance, control the door opening device not to open the identified door.

6. The refrigerator of claim 5, further comprising:

an outputter comprising at least one of a display or a speaker, wherein the processor is further configured to, based on the external object being identified in excess of the second threshold time within the second threshold distance, output guide information through the outputter.

7. The refrigerator of claim 2, further comprising:

a third proximity sensor disposed on the third door; and a fourth proximity sensor disposed on the fourth door, wherein the processor is further configured to control the third proximity sensor and the fourth proximity sensor to operate alternately.

8. The refrigerator of claim 7, wherein the processor is further configured to:

based on identifying that an external object exists in a predetermined area corresponding to the third proximity sensor while the first door is opened, control the door opening device to stop opening of the first door, and based on identifying that an external object exists in a predetermined area corresponding to the first proximity sensor while the second door is opened, control the door opening device to stop opening of the second door.

9. The refrigerator of claim 7, wherein the processor is further configured to:

turn off the second proximity sensor and the fourth proximity sensor while the first proximity sensor and the third proximity sensor are turned on, and turn on the second proximity sensor and the fourth proximity sensor while the first proximity sensor and the third proximity sensor are turned off.

10. The refrigerator of claim 7, wherein the third proximity sensor is disposed on a lower portion of the third door, wherein the fourth proximity sensor is disposed on a lower portion of the fourth door, and wherein a sensing direction of the third proximity sensor is different from a sensing direction of the fourth proximity sensor.

11. The refrigerator of claim 2, comprising:

a third proximity sensor and a fifth proximity sensor disposed on the third door; and a fourth proximity sensor and a sixth proximity sensor disposed on the fourth door, wherein the processor is further configured to:

turn off the second proximity sensor, the fourth proximity sensor, and the sixth proximity sensor while the first proximity sensor, the third proximity sensor, and the fifth proximity sensor are turned on, and turn on the second proximity sensor, the fourth proximity sensor, and the sixth proximity sensor while the first proximity sensor, the third proximity sensor, and the fifth proximity sensor are turned off, and wherein sensing directions of at least two sensors among the third proximity sensor to the sixth proximity sensor are different.

12. A control method of a refrigerator comprising a main body including a first door and a second door, a door opening device comprising a module for opening the first door and the second door, a first proximity sensor disposed adjacent to the first door, and a second proximity sensor disposed adjacent to the second door, the method comprising:

controlling the first proximity sensor and the second proximity sensor to operate alternately;

based on sensing data obtained by the first proximity sensor and the second proximity sensor, identifying a door close to an external object that approaches within a threshold distance from the refrigerator; and transmitting to the door opening device a signal for opening the identified door among the first door and the second door.

13. The method of claim 12, wherein the main body further comprises a third door disposed below the first door and a fourth door disposed below the second door, wherein the first proximity sensor is disposed on the third door, and wherein the second proximity sensor is disposed on the fourth door.

14. The method of claim 13, wherein the refrigerator further comprises:

a first light emitter disposed on the first door; and a second light emitter disposed on the second door, and wherein the method further comprises:

identifying information about an approach distance of the external object; and transmitting a signal for turning on at least one of the first light emitter or the second light emitter based on the identified information about an approach distance.

15. The method of claim 14, wherein the controlling of the at least one of the first light emitter or the second light emitter comprises:

based on the external object approaching within a first threshold distance, turning on at least one of the first light emitter or the second light emitter, the first light emitter and the second light emitter comprising at least one light emitting element, and based on the external object approaching within a second threshold distance that is shorter than the first threshold distance, transmitting a signal for turning on a light emitter disposed on the identified door of the first light emitter or the second light emitter to flicker.

16. The method of claim 15, further comprising:

based on identifying that the external object is positioned within the second threshold distance for a first threshold time, and then moves out of the second threshold distance, controlling the door opening device to open the identified door; and based on identifying the external object in excess of a second threshold time greater than the first threshold time within the second threshold distance, controlling the door opening device not to open the identified door.

17. The method of claim 16, wherein the refrigerator further comprises an outputter, the outputter comprising at least one of a display or a speaker, and wherein the method further comprises, based on the external object being identified in excess of the second threshold time within the second threshold distance, outputting guide information through the outputter.

18. The method of claim 13, wherein the refrigerator further comprises:

a third proximity sensor disposed on the third door; and a fourth proximity sensor disposed on the fourth door, and wherein the method further comprises controlling the third proximity sensor and the fourth proximity sensor to operate alternately.

19. The method of claim 18, further comprising:

based on identifying that an external object exists in a predetermined area corresponding to the third proximity sensor while the first door is opened, controlling the door opening device to stop opening of the first door; and based on identifying that an external object exists in a predetermined area corresponding to the fourth proximity sensor while the second door is opened, controlling the door opening device to stop opening of the second door.

20. The method of claim 18, further comprising:

turning off the second proximity sensor and the fourth proximity sensor while the first proximity sensor and the third proximity sensor are turned on; and turning on the second proximity sensor and the fourth proximity sensor while the first proximity sensor and the third proximity sensor are turned off.

* * * * *